US012680241B2

(12) United States Patent
Clark et al.

(10) Patent No.: US 12,680,241 B2
(45) Date of Patent: Jul. 14, 2026

(54) COUPLING FOR HYDRAULIC MOTOR

(71) Applicant: Reed International, Modesto, CA (US)

(72) Inventors: Kevin Clark, Modesto, CA (US); Jeffrey Reed, Modesto, CA (US); Douglas Hogue, Modesto, CA (US)

(73) Assignee: Reed International, Modesto, CA (US)

( * ) Notice: Subject to any disclaimer, the term of this patent is extended or adjusted under 35 U.S.C. 154(b) by 338 days.

(21) Appl. No.: 18/635,367

(22) Filed: Apr. 15, 2024

(65) Prior Publication Data

US 2024/0344276 A1 Oct. 17, 2024

Related U.S. Application Data

(63) Continuation of application No. 18/238,627, filed on Aug. 28, 2023, now Pat. No. 11,959,234, which is a continuation of application No. 17/987,422, filed on Nov. 15, 2022, now Pat. No. 11,739,480.

(51) Int. Cl.
*E01C 19/48* (2006.01)

(52) U.S. Cl.
CPC ..... *E01C 19/48* (2013.01); *E01C 2301/04* (2013.01)

(58) Field of Classification Search
CPC ..... E01C 19/48; E01C 2301/04; F16D 1/00; F16D 1/02; F16D 1/033
See application file for complete search history.

(56) References Cited

U.S. PATENT DOCUMENTS 3,749,505 A 7/1973 Miller
3,771,893 A 11/1973 Miller
3,889,782 A * 6/1975 Geis ..... B66F 9/07572 180/908
3,952,547 A * 4/1976 Klein ..... F16D 1/033 464/51
3,997,277 A 12/1976 Swisher, Jr. et al.
4,379,653 A 4/1983 Brown
4,502,558 A 3/1985 Mauri
4,589,460 A 5/1986 Albee
4,818,139 A 4/1989 Brock
(Continued)

FOREIGN PATENT DOCUMENTS

EP 1392930 B1 9/2010
JP 2008202350 A 9/2008
WO 2021133680 A1 7/2021

OTHER PUBLICATIONS

Hendrickson Severe-Service High-Capacity, Rubber Walking Beam Suspensions 65,000- to 120,000-lbs, downloaded Sep. 29, 2022, available online; "chrome-extension://efaidnbmnnnibpcajpcglclefindmkaj/https://www.hendrickson-intl.com/getattachment/38eb70c8-b88c-4c98-b772-e252661640ae/45745-015_Severe-Service-Rubber-Walking-Beam-Brochure_Rev.pdf".
(Continued)

*Primary Examiner* — Valentin Neacsu
*Assistant Examiner* — Michael R Stabley
(74) *Attorney, Agent, or Firm* — Sierra IP Law, PC; Mark D. Miller

(57) ABSTRACT

The present invention provides an improved coupling system between a differential of a vehicle and a hydraulic motor including mating flanges having complementary ridges and troughs that interengage with each other, and a plurality of splines on the motor drive shaft that engage with interior teeth on the flanges. The couplings of the present invention are particularly useful for operating vehicles for installing paving on asphalt roadways.

12 Claims, 24 Drawing Sheets

(56) References Cited

U.S. PATENT DOCUMENTS

| | | | | |
|---|---|---|---|---|
| 4,830,533 | A | 5/1989 | Miller | |
| 5,035,534 | A | 7/1991 | Brock | |
| 5,044,819 | A | 9/1991 | Kilheffer | |
| 5,127,887 | A | 7/1992 | Nuttal | |
| 5,188,193 | A * | 2/1993 | Schroeder | E02F 9/202 180/242 |
| 5,224,793 | A | 7/1993 | De Pol | |
| 5,287,938 | A | 2/1994 | Welling | |
| 5,419,654 | A | 5/1995 | Kleiger | |
| 5,470,175 | A | 11/1995 | Jensen | |
| 5,553,968 | A | 9/1996 | Campbell | |
| 5,735,634 | A | 4/1998 | Ulrich | |
| 5,749,595 | A | 5/1998 | Hoss et al. | |
| 5,846,022 | A | 12/1998 | Grundl | |
| 5,967,656 | A | 10/1999 | Andersson | |
| 6,220,782 | B1 | 4/2001 | Yates | |
| 6,688,450 | B2 | 2/2004 | Speers et al. | |
| 6,805,516 | B2 | 10/2004 | Barnat et al. | |
| 6,939,079 | B2 | 9/2005 | Lloyd | |
| 7,448,825 | B2 | 11/2008 | Kasahara et al. | |
| 7,458,747 | B2 | 12/2008 | Musil | |
| 7,470,082 | B2 | 12/2008 | Lloyd | |
| 7,572,081 | B2 | 8/2009 | Buschmann | |
| 8,388,070 | B2 | 3/2013 | VonSchonebeck | |
| 8,930,092 | B2 | 1/2015 | Minich | |
| 9,028,167 | B2 | 5/2015 | Buschmann | |
| 9,091,254 | B2 * | 7/2015 | Laird | B60K 6/12 |
| 9,309,926 | B2 * | 4/2016 | Schuermann | F16D 1/076 |
| 9,593,721 | B2 * | 3/2017 | Strandberg | F16D 3/223 |
| 9,845,579 | B2 | 12/2017 | Pembleton et al. | |
| 9,964,154 | B2 * | 5/2018 | Daining | F16D 1/101 |
| 10,323,692 | B2 * | 6/2019 | Lentini | F16D 3/387 |
| 11,603,887 | B2 * | 3/2023 | Kuckhoff | F16D 1/033 |
| 11,739,480 | B1 | 8/2023 | Clark et al. | |
| 2003/0012601 | A1 | 1/2003 | Barnat | |
| 2003/0218374 | A1 | 11/2003 | Kress | |
| 2004/0146354 | A1 | 7/2004 | Goodwin | |
| 2006/0088379 | A1 | 4/2006 | Lazic | |
| 2006/0204334 | A1 | 9/2006 | Guntert | |
| 2006/0281598 | A1 | 12/2006 | Petruska et al. | |
| 2009/0011890 | A1 * | 1/2009 | Bawks | F16H 48/142 192/53.4 |
| 2009/0097918 | A1 | 4/2009 | Larson | |
| 2010/0201128 | A1 * | 8/2010 | Bech | F03D 9/25 290/55 |
| 2011/0116931 | A1 * | 5/2011 | Dessoly | F16D 1/033 416/204 A |
| 2012/0288328 | A1 | 11/2012 | Minish | |
| 2015/0247294 | A1 | 9/2015 | Weiler | |
| 2015/0251533 | A1 | 9/2015 | Heren | |
| 2016/0115654 | A1 | 4/2016 | Pedersen | |
| 2016/0215458 | A1 | 7/2016 | Weiler | |
| 2017/0120739 | A1 * | 5/2017 | Wagner | B60K 17/36 |
| 2018/0142427 | A1 | 5/2018 | Tkachenko et al. | |
| 2019/0024761 | A1 * | 1/2019 | Gravina | F16H 3/728 |
| 2019/0203426 | A1 | 7/2019 | Guntert, Jr. et al. | |
| 2020/0018634 | A1 | 1/2020 | Fickeisen | |
| 2020/0278015 | A1 | 9/2020 | Chu | |
| 2021/0238814 | A1 | 8/2021 | Engelmann et al. | |
| 2022/0032768 | A1 | 2/2022 | Barillot et al. | |
| 2022/0055517 | A1 | 2/2022 | Ardison | |
| 2022/0134855 | A1 * | 5/2022 | Zhang | B60K 1/00 180/65.1 |
| 2022/0267966 | A1 | 8/2022 | Laycock et al. | |
| 2022/0332186 | A1 | 10/2022 | Mattsson | |
| 2023/0016830 | A1 * | 1/2023 | Kuckhoff | F16D 1/033 |

OTHER PUBLICATIONS

Bergkamp M1E4 Continuous Paver With EMCADS Pro, downloaded Oct. 11, 2022, available online; "https://www.bergkampinc.com/products/m1e-continuous-paver/".

Bergkamp website homepage, downloaded Jul. 12, 2022, available online; "https://www.bergkampinc.com/".

Hendrickson Parts List for Haulmaxx 40K 46K Rear Suspension, Lit No. SP-171, Aug. 2019 edition, downloaded Sep. 29, 2022, available online; "chrome-extension://efaidnbmnnnibpcajpcglclefindmkaj/https://www.hendrickson-intl.com/getattachment/910e486e-b3b4-4943-8704-a597a1415fe2/Sp171L.pdf".

Hendrickson Parts List for Steertek NXT High Capacity Steer Axle System for Autocar Vehicles, Lit No. SP-297, Apr. 2022 edition, downloaded Sep. 29, 2022, available online; "https://www.hendrickson-intl.com/resources/literature/parts-lists/sp-297-steertek-nxt-high-capacity-parts-list-for-autocar-vehicles".

Original document of foreign patent document EP1392930B1, downloaded Jul. 19, 2022, available online; "https://patents.google.com/patent/EP1392930B1/en?oq=EP1392930B1".

Original document of foreign patent document JP2008202350A, downloaded Jul. 19, 2022, available online; "https://patents.google.com/patent/JP2008202350A/en?oq=JP2008202350A".

English language abstract of foreign patent document JP2008202350A, downloaded Nov. 17, 2022, available online; "https://worldwide.espacenet.com/patent/search/family/039780132/publication/JP2008202350A?q=pn%3DJP2008202350A".

Original document of foreign patent document WO2021133680A1, downloaded Sep. 12, 2022, available online; "https://patents.google.com/patent/WO2021133680A1/en?oq=WO2021133680A1".

Danfoss H1 Bent Axis Variable Motor Size 110 cm3 data sheet, downloaded Sep. 30, 2022, available online; "chrome-extension://efaidnbmnnnibpcajpcglclefindmkaj/https://assets.danfoss.com/documents/75854/AI152886482826en-000306.pdf".

Danfoss H1P 115/130 Axial Piston Single Pumps data sheet, downloaded Sep. 30, 2022, available online; "chrome-extension://efaidnbmnnnibpcajpcglclefindmkaj/https://assets.danfoss.com/documents/195144/AI152886482843en-000801.pdf".

Danfoss H1P 147/165 Axial Piston Single Pumps data sheet, downloaded Sep. 30, 2022, available online; "chrome-extension://efaidnbmnnnibpcajpcglclefindmkaj/https://assets.danfoss.com/documents/195145/AI152886483081en-000801.pdf".

Danfoss H1 Bent Axis Variable Motor Size 060 cm3 data sheet, downloaded Sep. 30, 2022, available online; "chrome-extension://efaidnbmnnnibpcajpcglclefindmkaj/https://assets.danfoss.com/documents/75896/AI152886483391en-000305.pdf".

DEVI by Danfoss DEVIflex 10T data sheet, downloaded Sep. 30, 2022, available online; "chrome-extension://efaidnbmnnnibpcajpcglclefindmkaj/https://assets.danfoss.com/documents/202827/AI164786462659en-030306.pdf".

Danfoss Variable Displacement Pump H1 60/68 Tandem data sheet, downloaded Sep. 30, 2022, available online; "chrome-extension://efaidnbmnnnibpcajpcglclefindmkaj/https://assets.danfoss.com/documents/195396/AI175386484409en-000301.pdf".

Danfoss Programming key Type MMIMYK data sheet, downloaded Sep. 30, 2022, available online; "chrome-extension://efaidnbmnnnibpcajpcglclefindmkaj/https://assets.danfoss.com/documents/latest/162887/AI184586421031en-000701.pdf".

Danfoss PLUS+1 Propel Application Library data sheet, downloaded Sep. 30, 2022, available online; "chrome-extension://efaidnbmnnnibpcajpcglclefindmkaj/https://assets.danfoss.com/documents/86597/AI215986485366en-000203.pdf".

Danfoss Series 40 M46 Variable Pumps service manual, downloaded Sep. 30, 2022, available online; "chrome-extension://efaidnbmnnnibpcajpcglclefindmkaj/https://assets.danfoss.com/documents/50023/AX152886481201en-000303.pdf".

Danfoss Series 90 75 cc Axial Piston Motors parts manual, downloaded Sep. 30, 2022, available online; "chrome-extension://efaidnbmnnnibpcajpcglclefindmkaj/https://assets.danfoss.com/documents/50190/AX152886481822en-000302.pdf".

Danfoss Series 40 M46 Axial Piston Pump parts manual, downloaded Sep. 30, 2022, available online; "chrome-extension://efaidnbmnnnibpcajpcglclefindmkaj/https://assets.danfoss.com/documents/50484/AX152886485486en-000305.pdf".

Danfoss Selection of Driveline Components applications manual, downloaded Sep. 30, 2022, available online; "chrome-extension://efaidnbmnnnibpcajpcglclefindmkaj/https://assets.danfoss.com/documents/54370/BC157786484430en-000405.pdf".

(56) References Cited

OTHER PUBLICATIONS

Danfoss Series T90 Axial Piston Motors Size 055/075/100 technical information, downloaded Sep. 30, 2022, available online; "chrome-extension://efaidnbmnnnibpcajpcglclefindmkaj/https://assets.danfoss.com/documents/187524/BC195786485247en-000302.pdf".

Danfoss Propel Application Library (PAL) Software Function Blocks technical information, downloaded Sep. 30, 2022, available online; "chrome-extension://efaidnbmnnnibpcajpcglclefindmkaj/https://assets.danfoss.com/documents/56257/BC262271566298en-000302.pdf".

Danfoss Fan Drive Gear Motors Group 2 and Group 3 technical information, downloaded Sep. 30, 2022, available online; "chrome-extension://efaidnbmnnnibpcajpcglclefindmkaj/https://assets.danfoss.com/documents/157100/BC318050073602en-000102.pdf".

Danfoss Gear Motors Group 1, 2, and 3 technical information, downloaded Sep. 30, 2022, available online; "chrome-extension://efaidnbmnnnibpcajpcglclefindmkaj/https://assets.danfoss.com/documents/187481/BC319483612502en-000102.pdf".

Bendix Quick Reference Catalog, downloaded Sep. 30, 2022, available online; "chrome-extension://efaidnbmnnnibpcajpcglclefindmkaj/https://n0c357rmy1njbuit2friqwu.blob.core.windows.net/documents/BW1114_US_010.pdf".

Danfoss foreign language DCV CDS Multi-valve technical information manual, downloaded Sep. 30, 2022, available online; "chrome-extension://efaidnbmnnnibpcajpcglclefindmkaj/https://assets.danfoss.com/documents/54091/BC152886485125zh-CN0101.pdf".

International Search Report and Written Opinion from co-pending application PCT/US2023/031311, Forms PCT/ ISA/220, PCT/ISA/210, PCT/ISA/237 (Jan. 12, 2024).

International Preliminary Report on Patentabililty from co-pending application PCT/US2023/031311, Forms PCT/IPEA/416, PCT/IPEA/409 (Nov. 1, 2024).

* cited by examiner

SECTION A-A

DETAIL A

COUPLER HOUSING

COUPLING FOR HYDRAULIC MOTOR

FIELD OF THE INVENTION

The present invention relates generally to the asphalt pavement industry and, more particularly, relates to improved paving vehicles used for surfacing or resurfacing roadways or other pavement surfaces that are capable of traveling on their own to and from project sites at low or relatively high speeds without the need for being transported on a trailer, and related methods.

BACKGROUND OF THE INVENTION

Presently existing continuous slurry or micro surfacing systems frequently employ a low speed roadway paving vehicle that follows a supply truck along a roadway. In a typical system, the low speed paving vehicle applies asphalt binder material and aggregate material and fluids over a new or existing roadway to create or seal the roadway surface. A supply truck traveling in front of the paving vehicle carries a supply of the asphalt emulsion material, aggregate material and fluids for the purpose of continuously refilling the roadway paving vehicle with materials. In operation, a supply truck links with the roadway paving vehicle in real time as the roadway paving vehicle is moving forward, so that the paving vehicle may continuously dispense Slurry Seal or Micro Surfacing material, a mixture of aggregate material and fluids, while it is also being refilled by the supply truck. When the supply truck becomes empty, it is replaced by another supply truck, and so on, to maintain the continuous paving operation.

Many existing paving machines include a chassis supporting a pair of front wheels for steering, and two pairs of rear wheels in tandem for propulsion. Propulsion power is provided to many existing paving machines using four hydraulic motors, with a separate motor powering each of the four rear wheels. The use of hydraulic motors for propulsion of existing paving machines results in several significant limitations. Most significantly, the motors limit the speeds at which the machines may travel to not more than approximately 17-20 m.p.h., and to even slower speeds when traveling in reverse. In addition, these machines must rely on the hydraulic motors themselves for dynamic braking. As a result, it is necessary to bring these machines to and from a paving site on a trailer. However, using a trailer to deliver these paving machines is not always possible. In many cases, the central job site for a paving project (where materials and machines are stored and maintained) may be several miles from the actual paving location, and it may not be possible to use a truck or trailer to deliver the paving machine to the paving site (for example, the roadway between the job site and the paving location may be damaged or it may not yet exist). As a result, in these instances, the paving machine must travel on its own at very slow speeds for many miles between a job site and paving location; and in some cases, the paving machine must travel in reverse at an even slower speed to return from the paving site to the job site. Thus, existing paving machines suffer from the drawback of having to be delivered on a trailer, and/or from the drawback of delaying a paving project when delivery of the paving machine on a trailer is not possible.

In one existing paving machine, a gearbox was provided allowing the machine to be powered directly by a diesel engine in a travel mode and by a hydraulic motor in a paving mode; however, this machine was discontinued. The chassis was sourced from a truck crane manufacturer and further modified to suit the paving machine. With current emissions standards modifying an existing chassis by relocating the engine and or cooling or exhaust treatment systems would require cost-prohibitive re-certification of emissions standards. It is therefore desirable to provide paving machines that can be built on a chassis that can be used for either off-road use or on-road use, and need not be transported to or form a paving site on a trailer. It is also desirable to provide paving machines that are capable of traveling at low or relatively high speeds (in both forward and reverse) on their own.

In existing paving systems, the asphalt binder, aggregate materials and fluids are dispensed from the back of a supply truck or trailer using a gravity discharge apparatus. These materials drop from the discharge apparatus into a receiving hopper located on the paving machine. An auger or other conveying means is provided that extends underneath the hopper. This conveyor apparatus is used to move these materials up into the paving machine for further processing before application to the roadway. Because existing paving systems utilize gravity to dispense the asphalt materials from the supply truck to the paving machine, the receiving hopper and the bottom of the conveying apparatus on the paving machine must be very close to the ground, leaving very little clearance between the bottom of the conveying apparatus and the ground itself which presents problems when loading or unloading the paving machine from the trailer upon which it must be transported. The paving machine must travel up a ramp onto the trailer without the conveying apparatus contacting the ramp. In order to load or unload one existing paving machine, the frame of the machine is raised from its front axle in order to lift the front of the machine along with the conveying apparatus high enough to avoid contact with the ramp when the machine is loaded or unloaded from the trailer. It is therefore desirable to provide paving machines that may be easily loaded onto and unloaded from travel trailers without damage to the conveyor from contact with the trailer on/off ramp.

SUMMARY OF THE INVENTION

The present invention provides improved paving vehicles for following a supply truck for use in paving asphalt roadways. Embodiments of the paving vehicles of the present invention need not be transported on a trailer, and are capable of traveling on or off road, at low or relatively high speeds on their own, in both forward and reverse directions. This is accomplished in embodiments of the invention through the use of a novel chassis and drive system apparatus and methods. Embodiments of the paving vehicles of the present invention may include chassis and propulsion systems having two rear axles, with each axle coupled directly to its own hydraulic motor, such that each of the two hydraulic motors provides power to one axle (two wheels). Embodiments of the present invention use of two hydraulic motors each coupled directly to one of the two rear axles, instead of wheel motors used in existing machines which are located at each of the four rear wheels and severely limit the speeds at which the paving machine may travel. This allows embodiments of the paving vehicles of the present invention to travel at road-worthy speeds. For example and without limitation, embodiments of the present invention may travel at low off-road speeds of under 25 m.p.h., but also at higher on-road speeds in excess of 25 m.p.h, up to as high as 60 m.p.h., and to also travel in reverse at significantly higher speeds than existing machines. These features make it possible for embodiments of the invention to travel on their own to a paving site, instead of being transported on a trailer. These features also make it possible for embodiments of the invention to incorporate spring suspension systems instead of relying on the air in the tires as the only cushions. In addition, these features allow for the use of air brakes instead of relying solely on the hydraulic system itself for braking, as in existing machines.

In some embodiments of the invention, a reciprocating conveyor apparatus may be provided that may be moved to a lowered position to receive the gravity discharge of materials from a hopper and supply truck during a paving operation, and moved to a raised position in order to provide a wide margin of ground clearance when the paving vehicle moves from one location to another. Embodiments of the reciprocating apparatus also make it possible to provide the paving vehicle with leaf suspension systems for the front axle of the paving vehicle, eliminating the lifting mechanism used in existing machines to lift the front of the vehicle during loading and unloading from a trailer. In embodiments of the invention, an angled conveyor is provided at the front of the paving machine for conveying asphalt binder materials, aggregate materials and fluids into the machine. Embodiments of the conveyor may be in the form of an elongated rectangular box or channel having an interior and an exterior, with openings at both ends. A continuous movable belt may be provided on the interior of the elongated box. The belt may be wrapped around cylinders or rollers at opposite ends of the box such that rotation of one or more of the cylinders causes the belt to slide along the bottom of the box in order to convey paving materials from the lower end of the box to the upper end of the box. Belt tighteners may also be provided.

In these embodiments of the invention, the angled conveyor box is reciprocally mounted inside the machine such that it may be adjustably moved from as low as a lowermost position to as high as an uppermost position, or any position in between. A lower or lowermost position may be used during a paving operation the exact position depending on the position of the hopper and the supply truck used in the operation. An upper or uppermost position may be used when the paving machine is not in use, such as during transport or storage. At least one motion imparting apparatus is attached to the conveyor box to move it from or between lowermost and uppermost positions. The motion imparting apparatus may be in the form of, without limitation, one or more hydraulic pistons, air pistons, motors, cams, linkages or other devices. At least one smooth surface is provided on the bottom exterior of the conveyor box, and at least one bearing surface is provided on the frame of the paving vehicle to make contact with the smooth surface(s). The smooth surface(s) of the box slide along the bearing surface (s) of the frame when the box is moved between upper and lower positions. A plurality of additional bearing surfaces may also be provided laterally along both sides of the conveyor box to guide the box along a straight path as it reciprocates between upper and lower positions.

In these embodiments of the invention, a first opening is provided in the top of the conveyor box at a lower end thereof for receiving paving materials from an input hopper at the front end of the paving vehicle. Paving materials are deposited into the hopper from an adjacent supply truck during paving operations. Once the supply truck is engaged with the hopper, the conveyor box is moved to a lower or lowermost position in order to move the first opening in the top of the box to a position that is below an exit chute of the hopper. This allows paving materials to drop from the supply truck, through the hopper, and into the conveyor box. The movable belt may then be used to transport materials from the bottom to the top of the angled conveyor box during paving operations. A second opening is provided at the top of the conveyor box of embodiments of the invention through which the paving materials may exit from the conveyor box for further processing inside the paving vehicle.

In use, the angled conveyor box is moved to an upper position to allow the paving vehicle to travel to a location where roadway paving is to take place. This may be accomplished using a motion imparting apparatus such as for example and without limitation, one or two hydraulic pistons, which may have a range of up to about eighteen inches (18"), allowing the conveyor box to be moved this distance, i.e., up to about 18" between lower and upper positions. In some embodiments, a suitable distance between upper and lower positions of the conveyor box is approximately fourteen inches (14"). The conveyor box is raised at an angle, which may be between 20 degrees and 40 degrees from horizontal, and preferably around 30-32 degrees from horizontal. Smooth lower surfaces may be provided on the box for sliding against corresponding bearing surfaces of the paving machine frame. Lateral guides on both sides of the conveyor box prevent it from deviating from a straight path as it moves up or down. Raising the conveyor box to an upper position allows the paving machine to travel at relatively high speeds (e.g., more than 20 m.p.h. or higher) through use of variable displacement hydraulic motors, and also gives the paving machine considerable maneuverability such as, without limitation, being able to easily turn left, turn right, or turn around.

Once an embodiment of paving vehicle is moved into position to perform paving operations, supply truck is engaged with the hopper at the front of the paving vehicle in order to receive asphalt materials from the supply truck. The conveyor box may then be moved to a lower position such that materials deposited into the hopper from the supply truck fall through a chute into an upper opening in the conveyor box. The materials may then be conveyed upward on a belt on the interior of the conveyor box to an opening at the top where the materials exit into the paving machine for further processing before being applied to the roadway. Once the paving operation is completed, the supply truck may be moved away, the conveyor box may be raised, and the paving vehicle may be driven away on its own, without necessarily being transported on a trailer.

In some aspects, embodiments of the invention provide a paving vehicle comprising a chassis comprising a raised front frame and a raised rear frame separated by a lower central frame; a front axle attached to the raised front frame; a pair of rear axles attached to the raised rear frame, each rear axle including a differential attached to a drive axle; a pair of hydraulic motors, one for each of the pair of rear axles; a first coupler provided between a first of the hydraulic motors and a first of the rear drive axles, the first coupler comprising a motor output flange and a pinion input flange; and a second coupler provided between a second of the hydraulic motors and a second of the rear drive axles, the second coupler comprising a second motor output flange and a second pinion input flange. In other aspects, the paving vehicle may be provided with front and/or rear spring suspension systems. In other aspects, the paving vehicle may be provided with front and/or rear air brake systems. In other aspects, the paving vehicle may be provided with an input hopper attached to the front frame for receiving asphalt materials from a supply truck. In other aspects, the paving vehicle may be provided with an angled conveyor assembly for conveying said materials received from said hopper assembly to an interior mixing chamber of said paving machine. In other aspects, the angled conveyor assembly may be reciprocatable.

In other aspects, embodiments of the present invention provide paving machines comprising a hopper assembly attached at a front of the machine for receiving paving materials from a supply truck, the hopper assembly having a lower opening therein; a movable angled conveyor assembly for conveying paving materials received from the hopper assembly to an interior of the paving machine, the conveyor assembly further comprising: an elongated rectangular box having an interior and an exterior; a movable continuous belt inside the box for conveying paving materials through the box; a first opening in a top of the box at a lower end thereof for receiving paving materials from the hopper; a second opening at an upper end of the box through which paving materials exit the box; and at least one motion imparting device attached to the box for imparting reciprocating motion to the box to move the box between a first lower position and a second upper position.

In other aspects, the paving machines of embodiments of the present invention may further comprise at least one smooth lower exterior surface on the box and at least one corresponding bearing surface on the vehicle for slidably supporting the smooth surface as the box reciprocates between upper and lower positions. In other aspects, the paving machines of the present invention may further comprise a plurality of lateral bearing surfaces outside of the paving machines of embodiments of the present invention box for guiding the paving machines of embodiments of the present invention box along a straight path as the paving machines of embodiments of the present invention box reciprocates between upper and lower positions. In embodiments of the invention, the first opening is located below the lower hopper opening when the conveyor box is in the first lower position. In embodiments of the invention, the distance between the first lower position and the second upper position may be between about 8 inches and about 18 inches. In embodiments of the invention, the distance between the first lower position and the second upper position is about 14 inches.

In other aspects, the paving machines of embodiments of the present invention may further comprise a chassis having a front frame member supporting a first pair of rotatable front wheels on a first axle, and a rear frame member supporting a second pair of rotatable rear wheels on a second axle and a third pair of rotatable rear wheels on a third axle. In other aspects, the paving machines of the present invention may further comprise a first adjustable hydraulic motor for imparting motion to the second axle, and a second adjustable hydraulic motor for imparting motion to the third axle. In other aspects, the paving machines of the present invention may further comprise at least one air brake mounted adjacent to at least one of the rear wheels.

In other aspects, embodiments of the present invention provide methods for installing paving on a roadway comprising the steps of raising a movable angled conveyor apparatus on a paving machine to an upper position; driving the paving machine to a location where paving is to be performed; engaging a hopper assembly at a front of the paving machine with a supply truck to receive to asphalt paving materials from the supply truck; lowering the angled conveyor apparatus to a lower position such that an upper opening in the conveyor apparatus corresponds to a lower opening in the hopper; and operating the paving apparatus to install paving on the roadway. In further aspects, embodiments of the present invention include the additional steps of raising the movable angled conveyor apparatus back to an upper position, and then driving the paving machine away from the paving location.

It is therefore an object of the present invention to provide methods and apparatus for paving and sealing roadways using a paving machine vehicle that is capable of maneuvering and traveling on its own to and from a paving site at relatively high speeds without the need for being transported on a trailer.

It is also an object of the present invention to provide methods and apparatus for paving and sealing roadways using a paving machine vehicle having a unique chassis and drive mechanism in which each of two variable displacement hydraulic motors are coupled directly to each of two rear axles of the machine.

It is also an object of the present invention to provide paving machine vehicles that are capable of traveling on their own at speeds of over 20 m.p.h. in forward and in reverse when not performing paving operations.

It is also an object of the present invention to provide paving machine vehicles that are capable of traveling on their own at road-worthy speeds without the need to be transported on a trailer.

It is also an object of the present invention to provide methods and apparatus for paving and sealing roadways using a paving machine vehicle having a reciprocating conveyor that may be raised to allow the paving machine vehicle to be loaded and unloaded from a trailer without risking damage to the machine itself.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention, including different combinations of the features identified herein. In the following disclosure, specific details are given to provide a thorough understanding of the invention. However, it will be apparent to one skilled in the art that the present invention may be practiced without all of the specific details provided.

Figure 1:
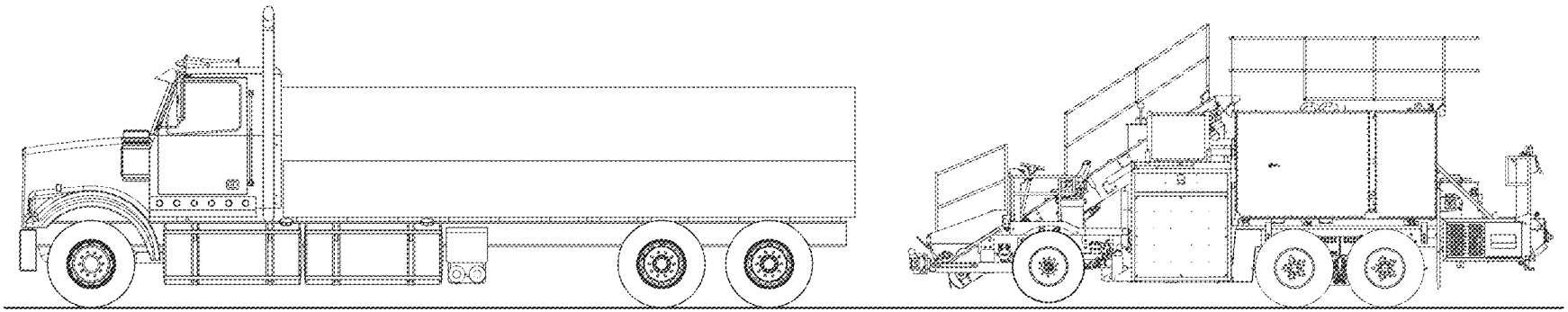
FIG. 1 is a side view of a supply truck and an embodiment of the paving machine vehicle of the present invention.
Figure 2:
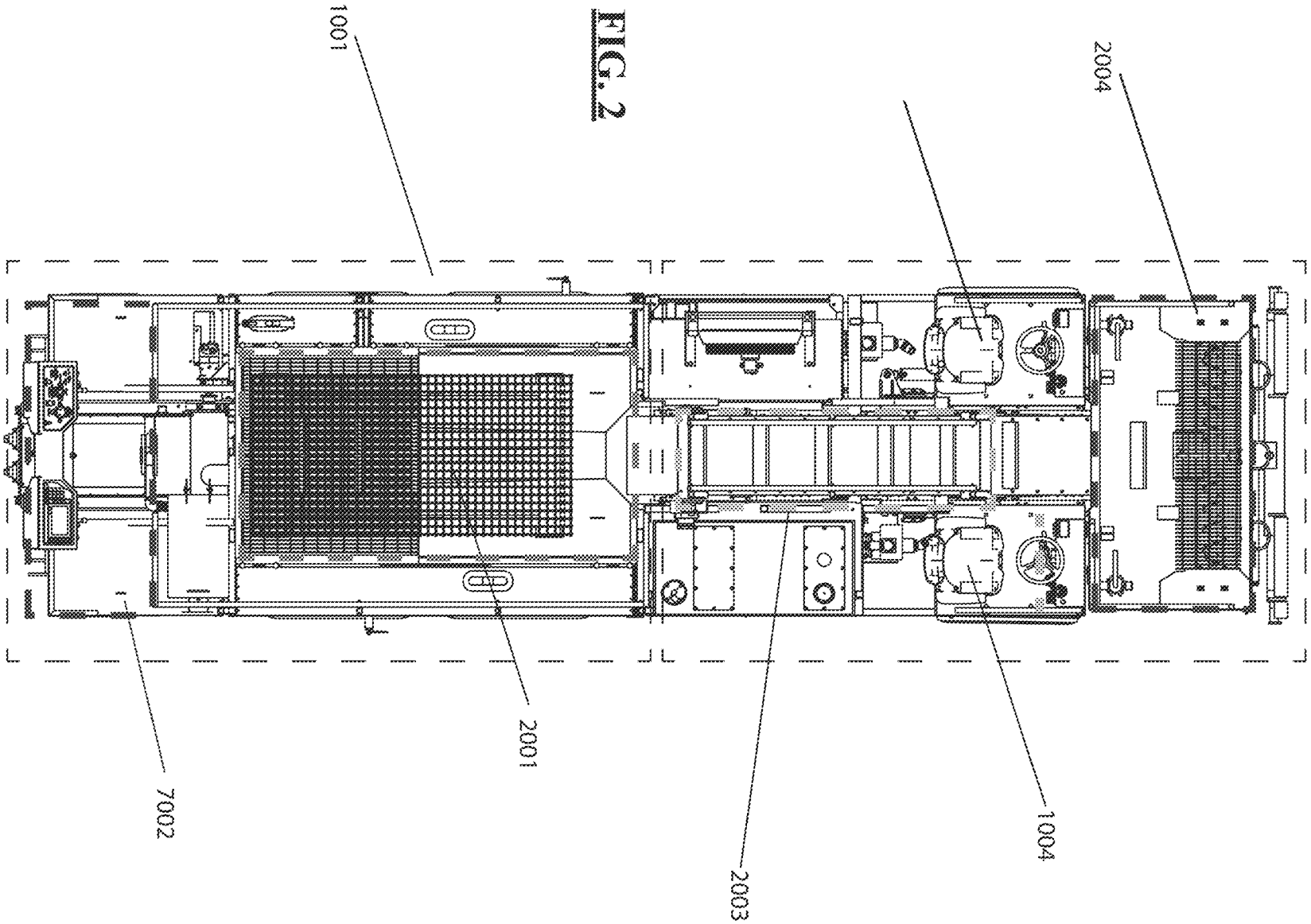
FIG. 2 is a top view of an embodiment of the present invention.
Figure 3:
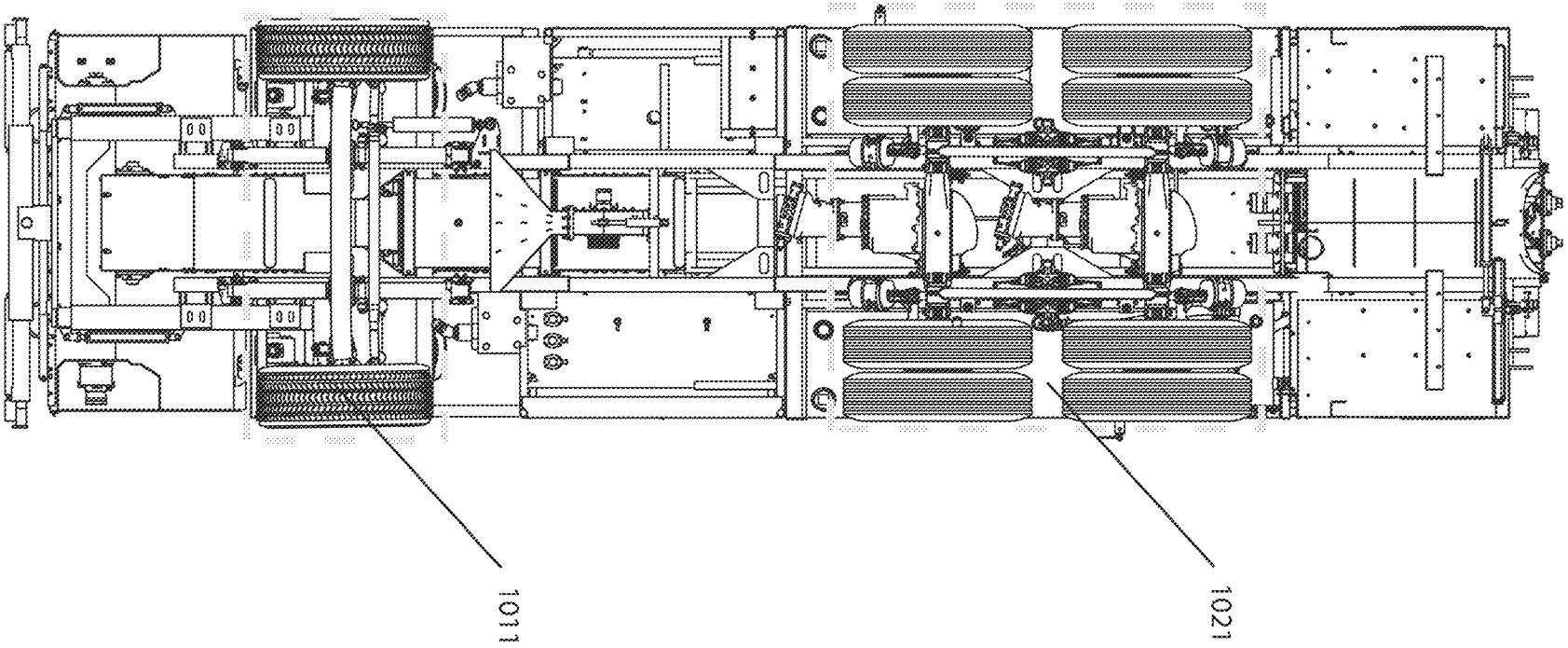
FIG. 3 is a bottom view of an embodiment of the present invention.
Figure 4:
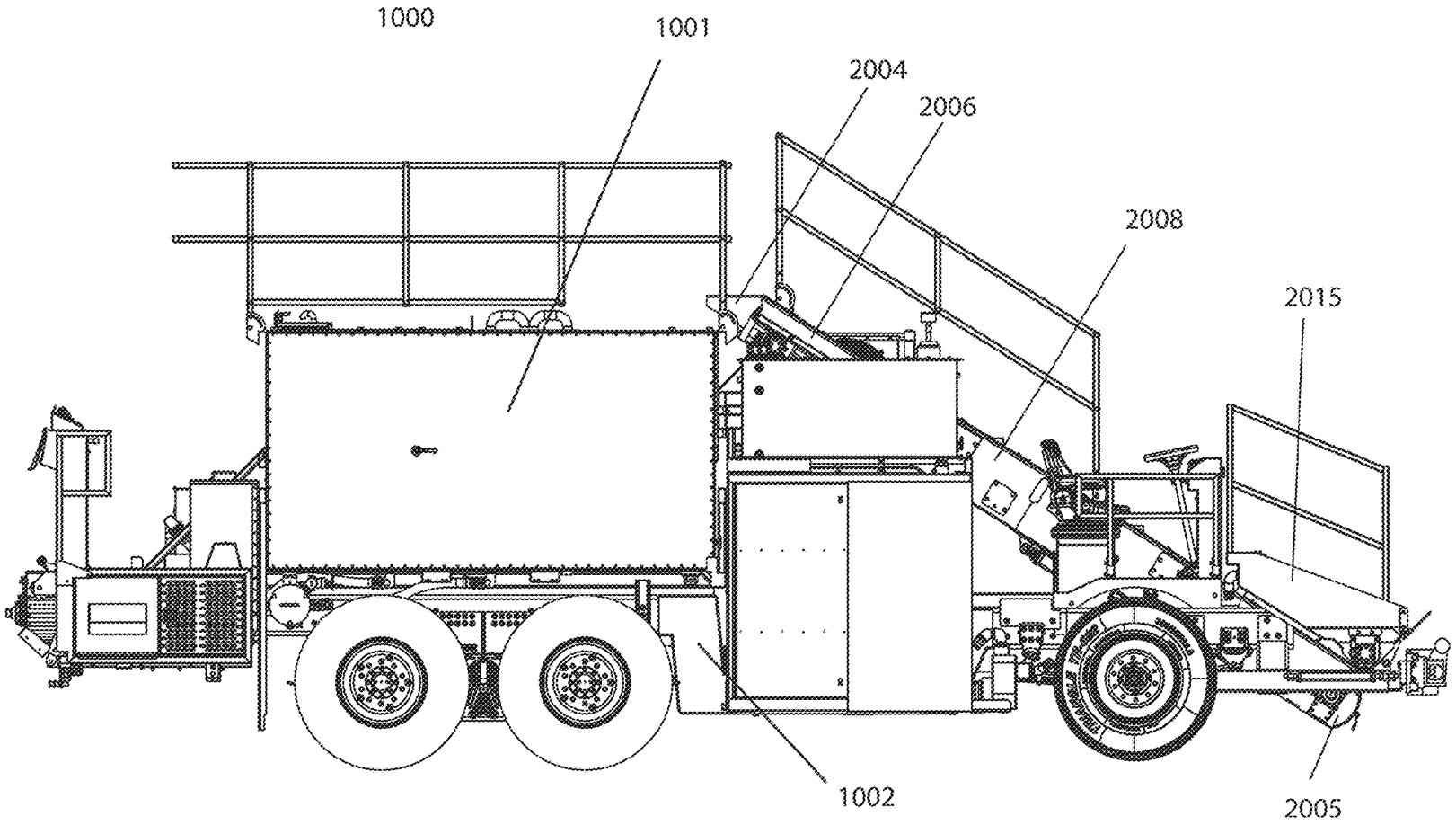
FIG. 4 is a side view of an embodiment of the present invention.
Figure 5:
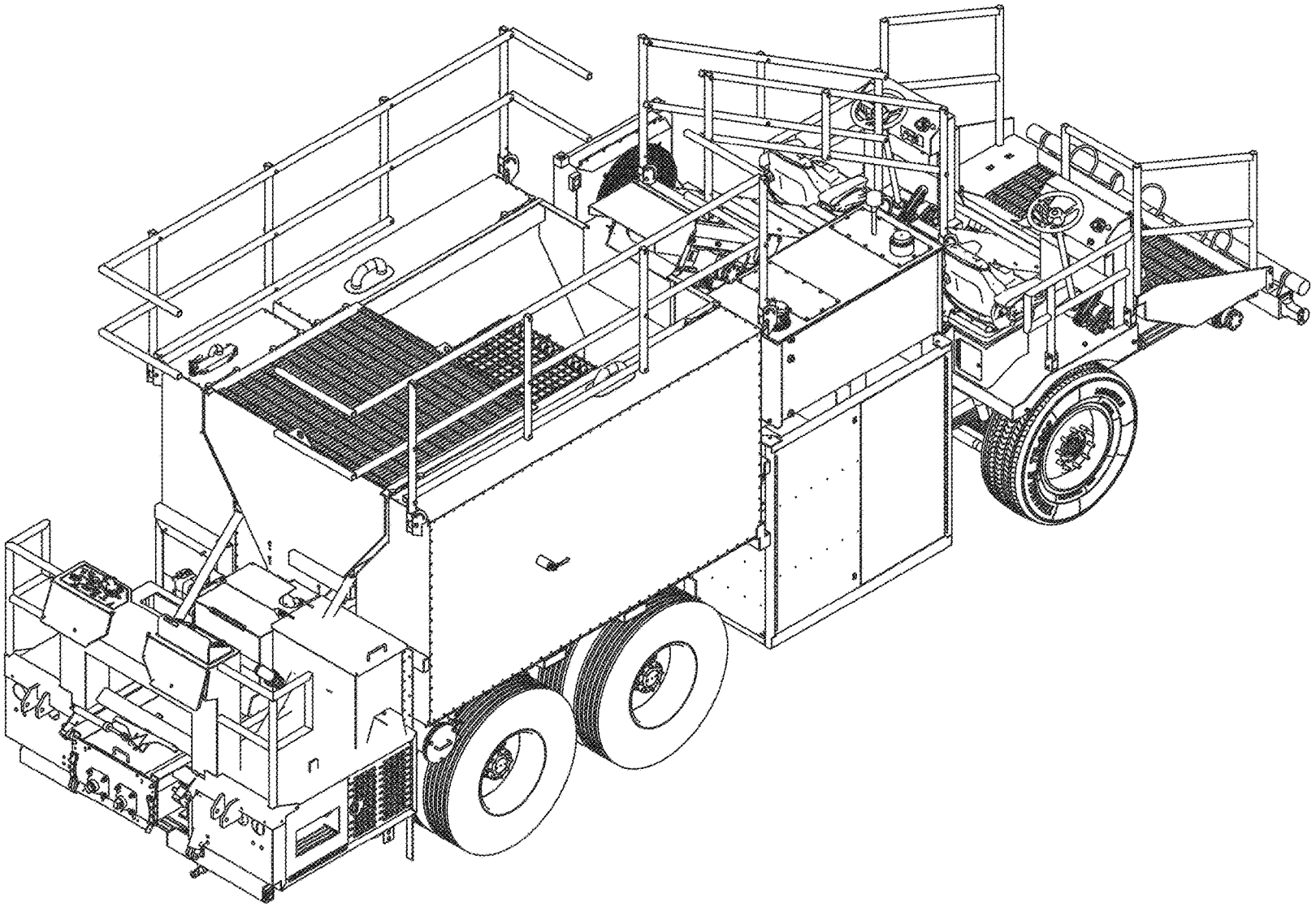
FIG. 5 is a rear perspective view of an embodiment of the present invention.
Figure 6:
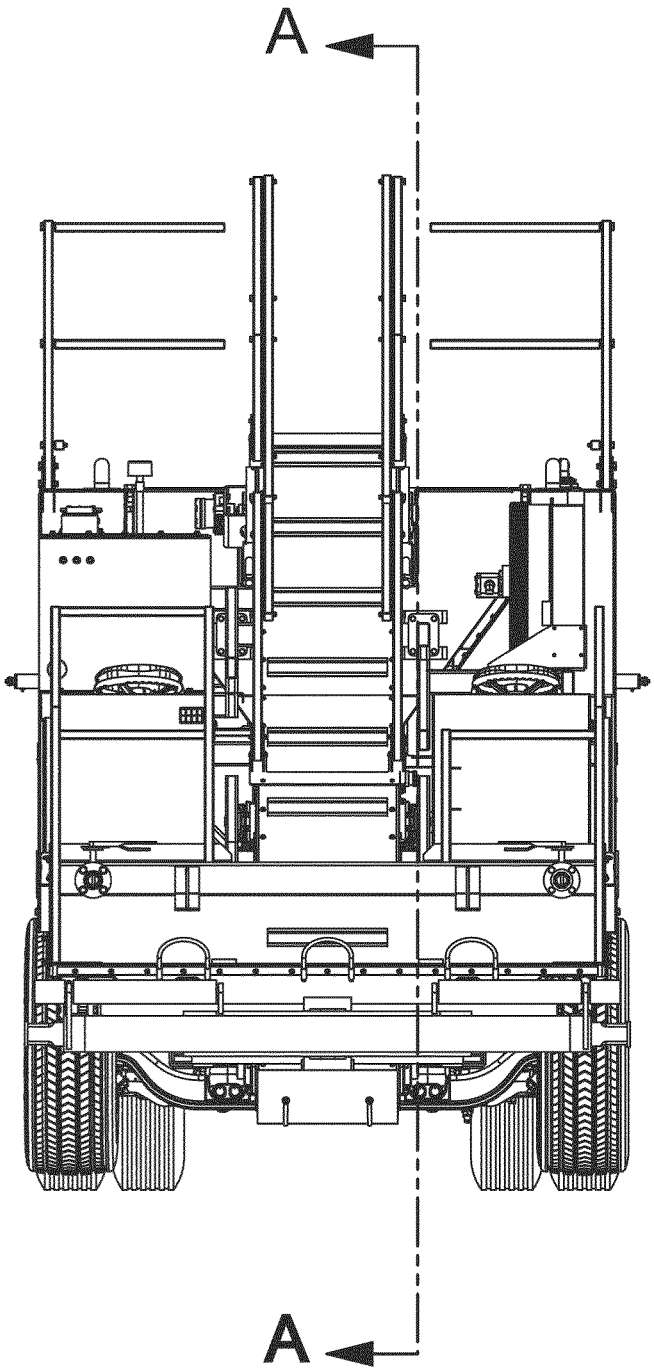
FIG. 6 is a rear view of an embodiment of the present invention.
Figure 8:
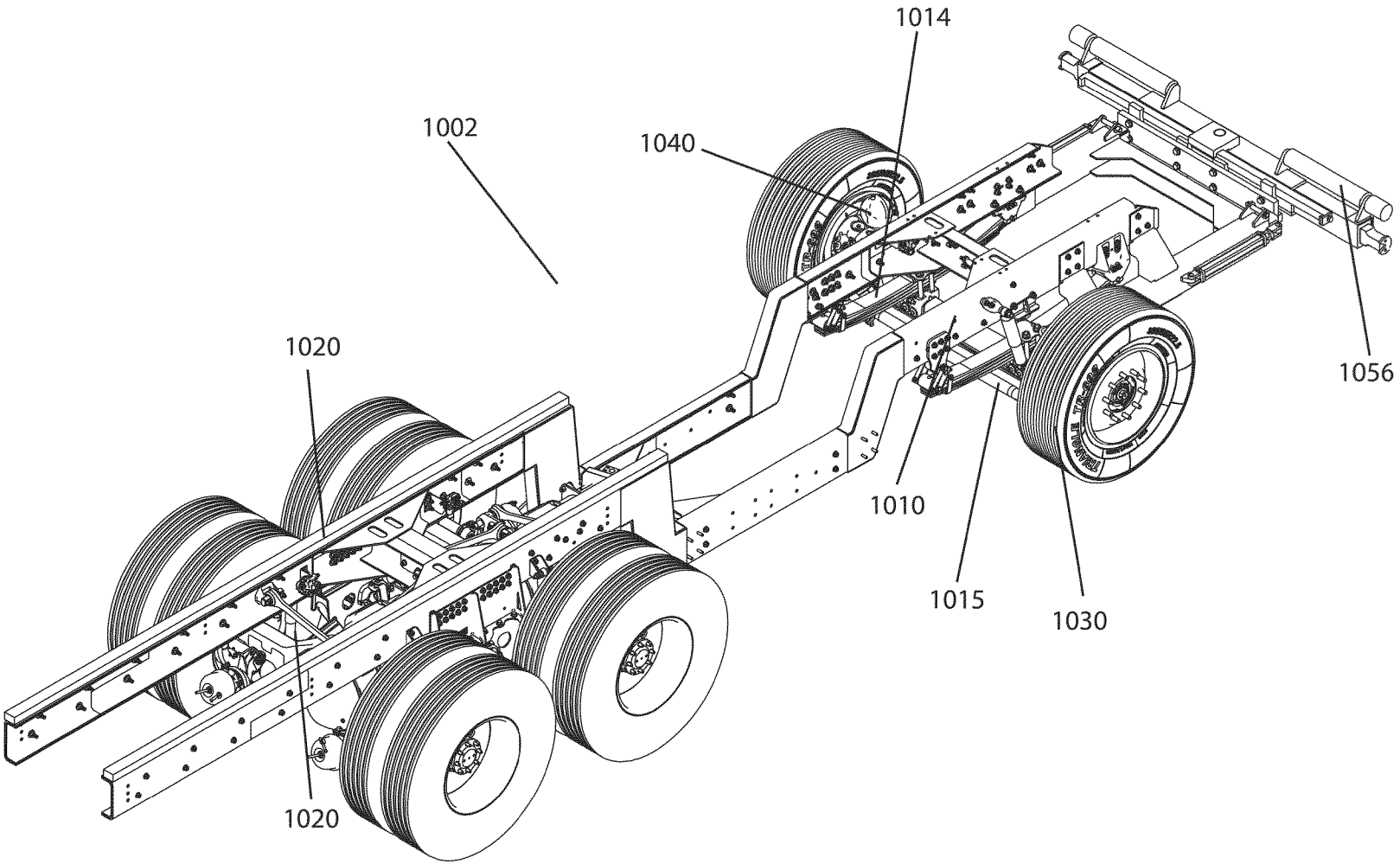
FIG. 8 is a perspective view of a lower frame assembly of an embodiment of the present invention.

Referring to the drawings, wherein like reference characters designate like or corresponding parts throughout the several views, and referring first to FIG. 1, it is seen that the present invention includes a paving machine 1000 designed to follow a supply truck 999 for applying asphalt binder material and aggregate material over a new or existing roadway. Referring to FIGS. 4 and 8, it is seen that the paving machine is also a vehicle that that capable of traveling on its own, and is mounted on a frame/chassis 1002 which supports a central chamber 1001 for heating and mixing asphalt paving materials, an engine, a front hopper assembly 2015, a rear observation platform, a pair of front wheels 1030 on a front axle 1012, and two pairs of rear wheels 1031 mounted on real axles 1032, 1033.

Figure 18:
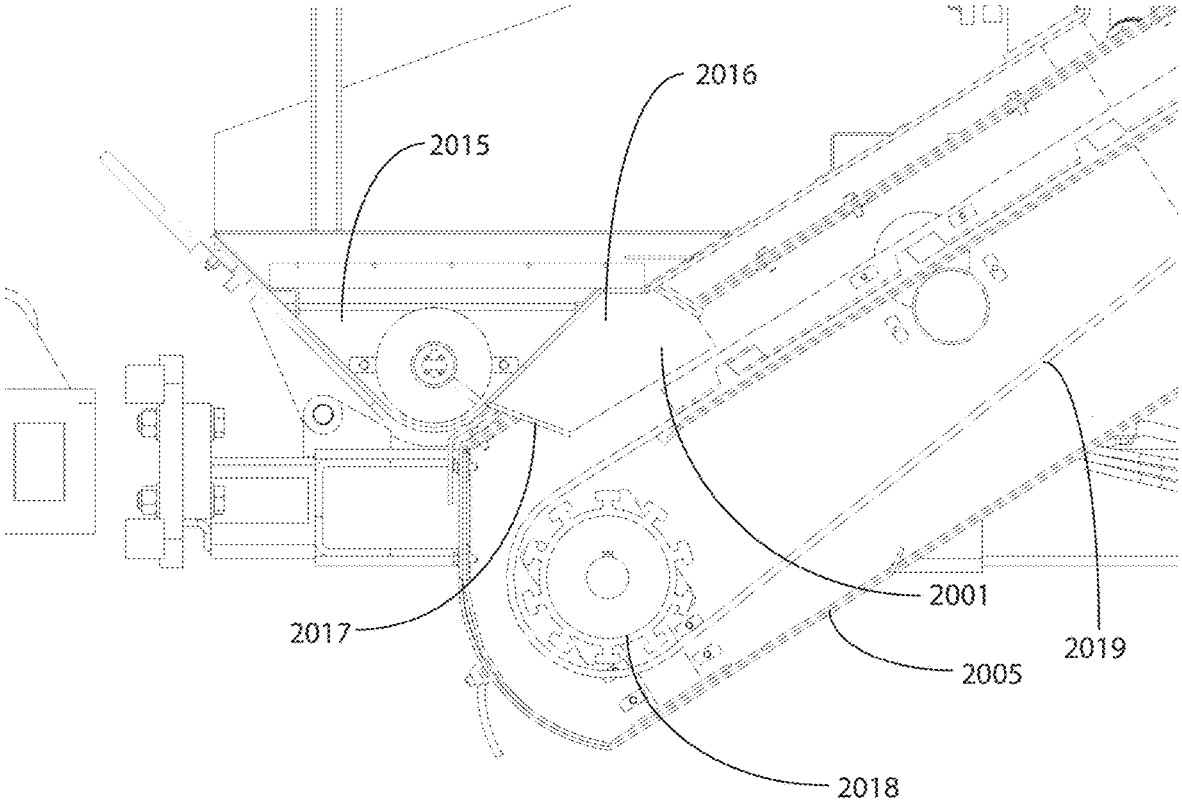
FIG. 18 is a detailed side sectional view of a front hopper and loading assembly of an embodiment of the present invention.

As seen in FIGS. 4-7, an adjustable hopper assembly 2015 is provided at the front of the vehicle 1000, and is attached to the front portion 1011 of frame 1002. The supply truck 999 may be engaged with the hopper assembly 2015 which receives the output from the supply truck 999. A movable angled conveyor assembly 2003 is provided at the front of the vehicle 1000, having a lower end 2005 and an upper end 2006 for delivering paving materials from said hopper 2015 to said mixing chamber 1001. Referring to FIGS. 18-19, it is seen that the illustrated embodiment of the conveyor assembly 2003 may be in the form of an elongated rectangular box or channel 2008 having an interior and an exterior. A continuous movable belt 2019 is provided on the interior of the box 2008, and is wrapped around cylinders or rollers 2018 at opposite ends of the box which may be operated by a motor 2021 such that rotation of one or more of the cylinders causes the belt to slide along the bottom of the box in order to convey paving materials from the lower end of the box 2005 to the upper end of the box 2006. A motor mount 2022 and adjusting screw 2023 may be provided in embodiments to maintain tension on the belt. A first opening 2001 is provided in the upper surface of conveyor box 2006 at the lower end 2005 for receiving paving materials from hopper 2015. Hopper 2015 has an opening 2016 at a bottom thereof through which paving materials may fall by gravity through a chute 2017 and into opening 2001. Materials that fall through opening 2001 are conveyed upward through the angled conveyor assembly on the belt until they are discharged through upper opening 2004 into mixing chamber 1001.

Figure 7A:
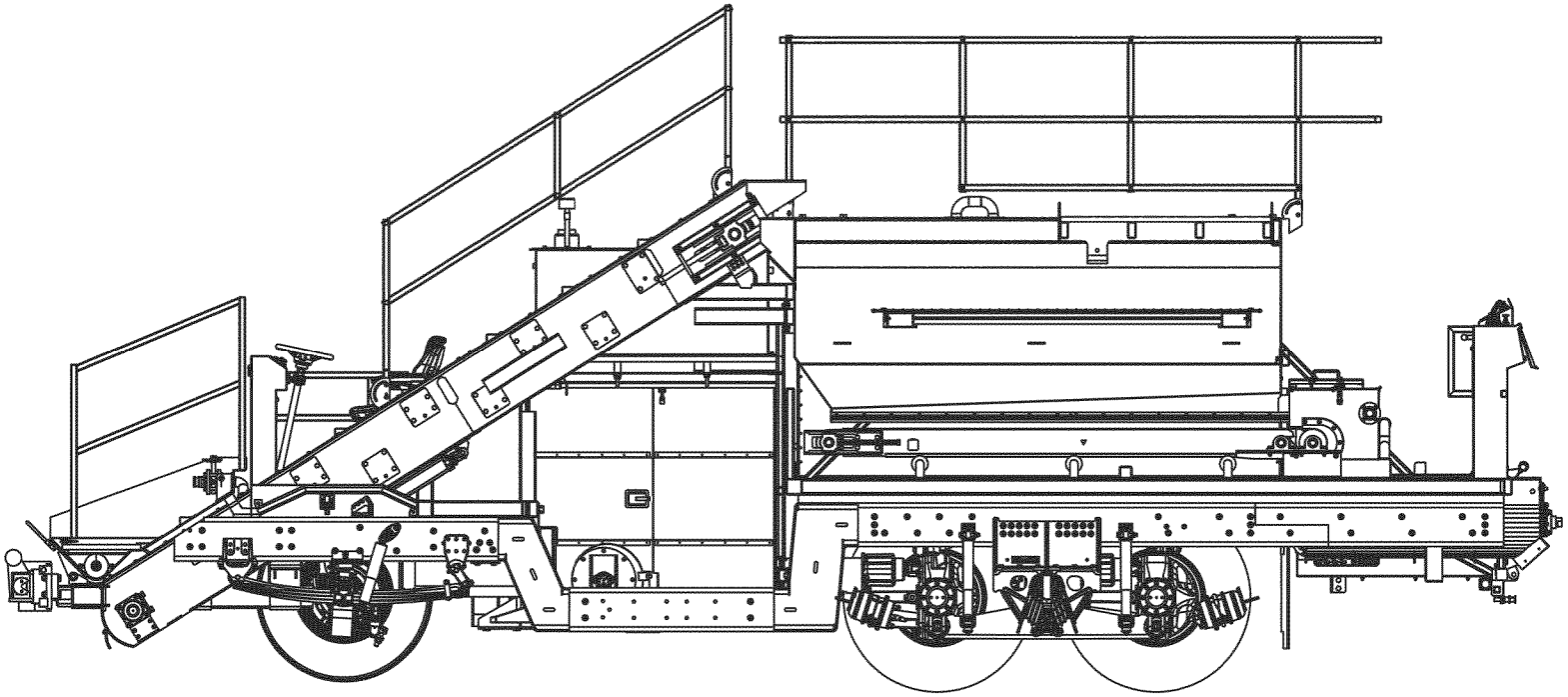
FIG. 7A is a sectional view of an embodiment of the present invention along line A-A of FIG. 6.
Figure 7B:
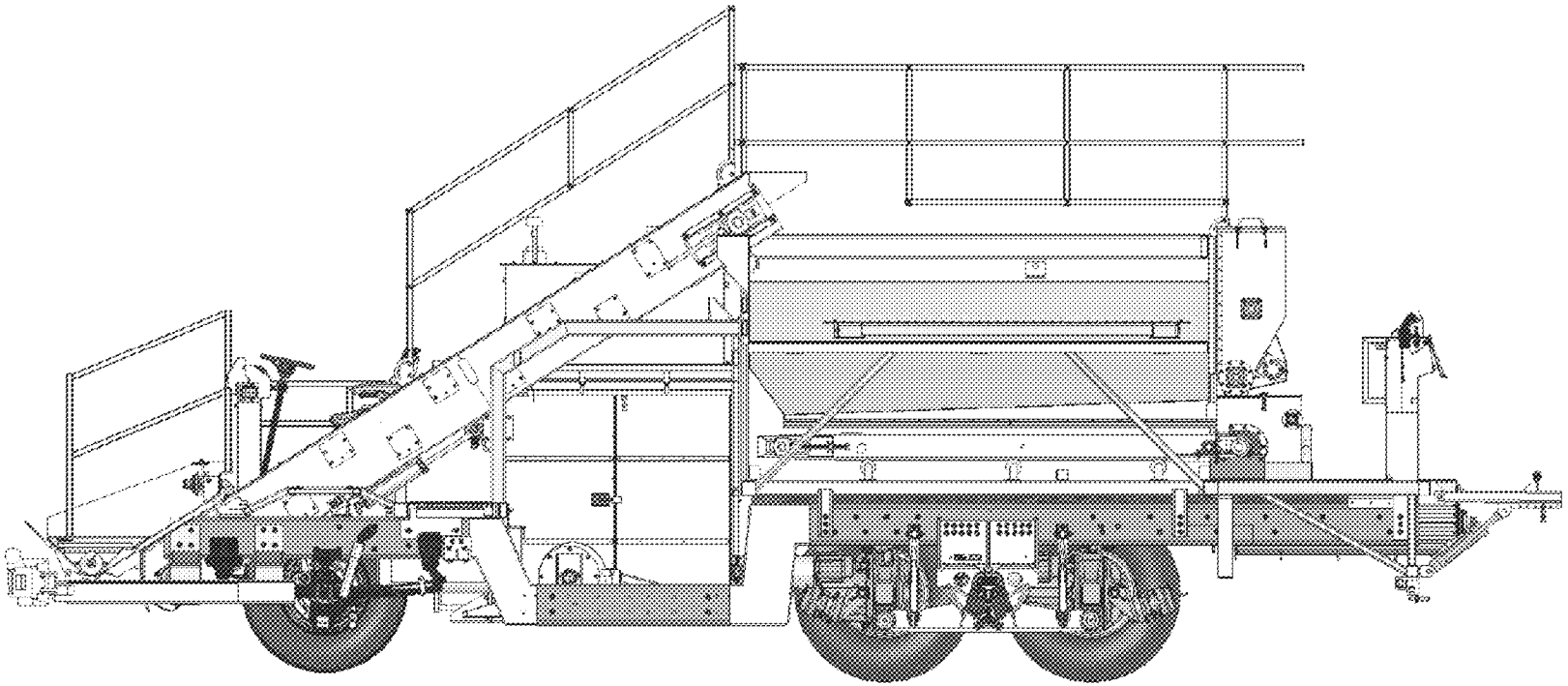
FIG. 7B is a sectional view of an embodiment of the present invention showing the conveyor apparatus in a raised position.

In the illustrated embodiment, angled conveyor box 2003 is reciprocally mounted inside the vehicle 1000 such that it may be adjustably moved from a lowermost position as shown in FIGS. 4 and 7A, to an uppermost position shown in FIG. 7B, or to any position in between. Conveyor 2003 may be moved to a lower or lowermost position during a paving operation, so that opening 2001 is underneath chute 2017 of the hopper 2015 receiving materials from the supply truck 999. Conveyor 2003 may be moved to an upper or uppermost position when the paving machine is not in use, such as during transport or storage.

Figure 16:
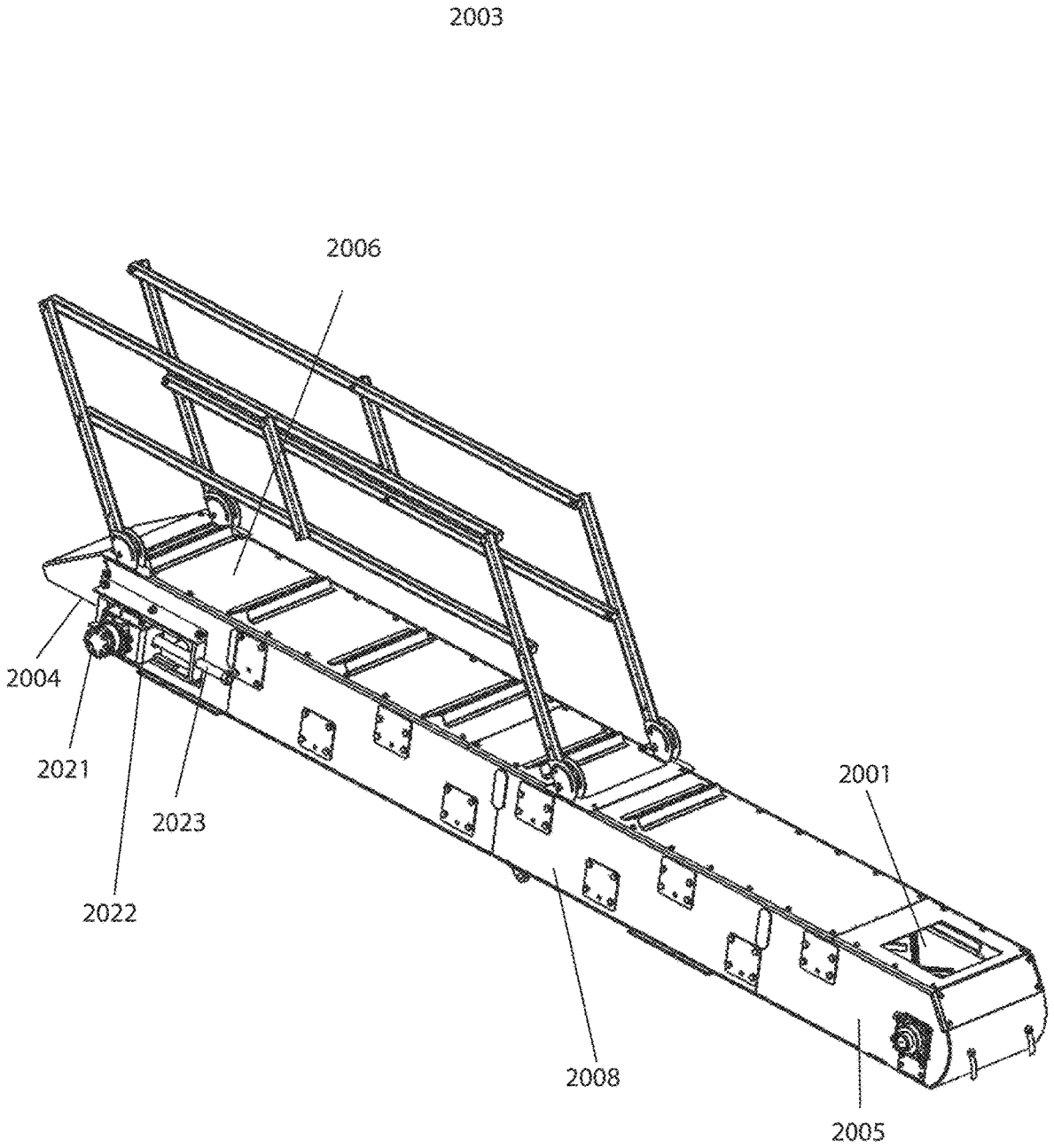
FIG. 16 is an isolated top perspective view of a conveying apparatus of an embodiment of the present invention.
Figure 16A:
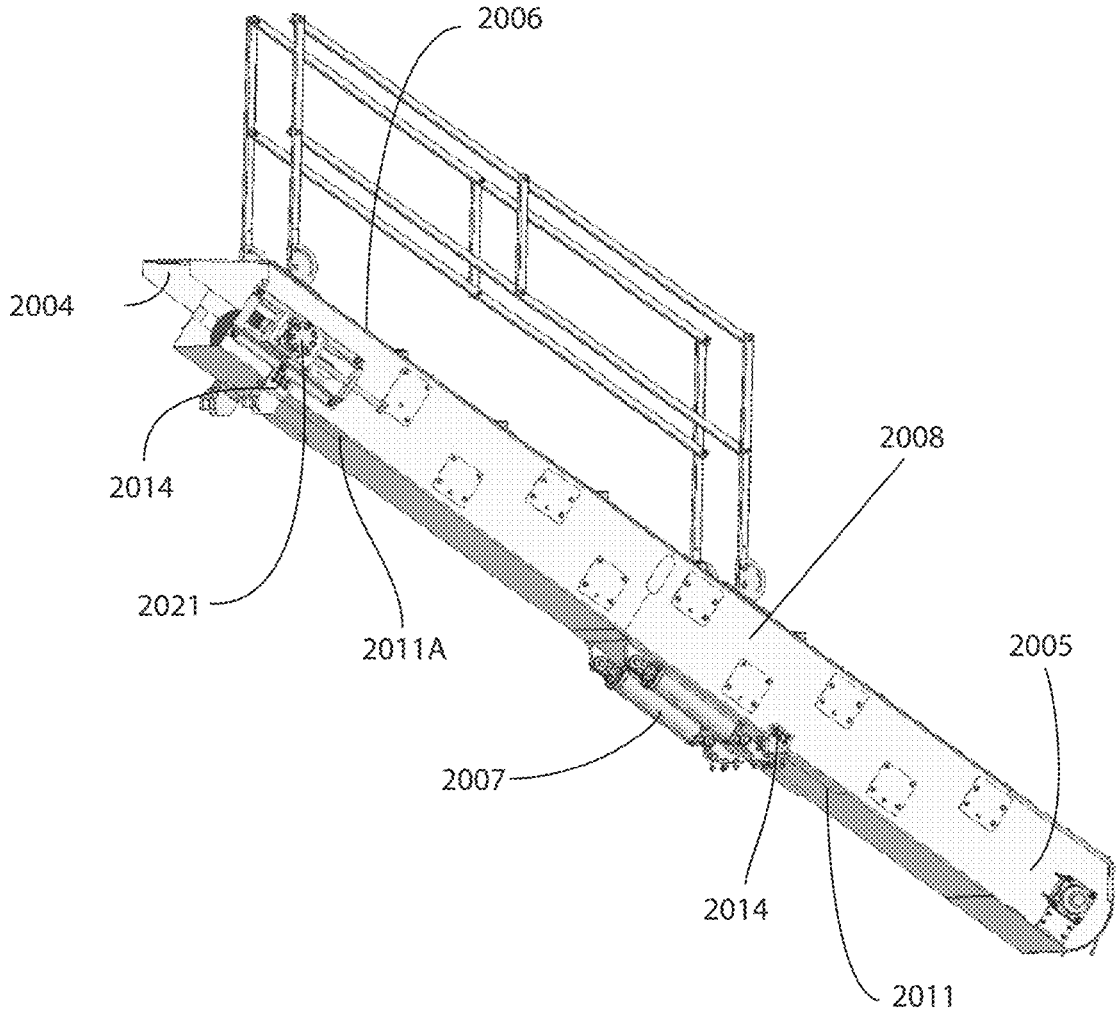
FIG. 16A is an isolated bottom perspective view of a conveying apparatus of an embodiment of the present invention.
Figure 17:
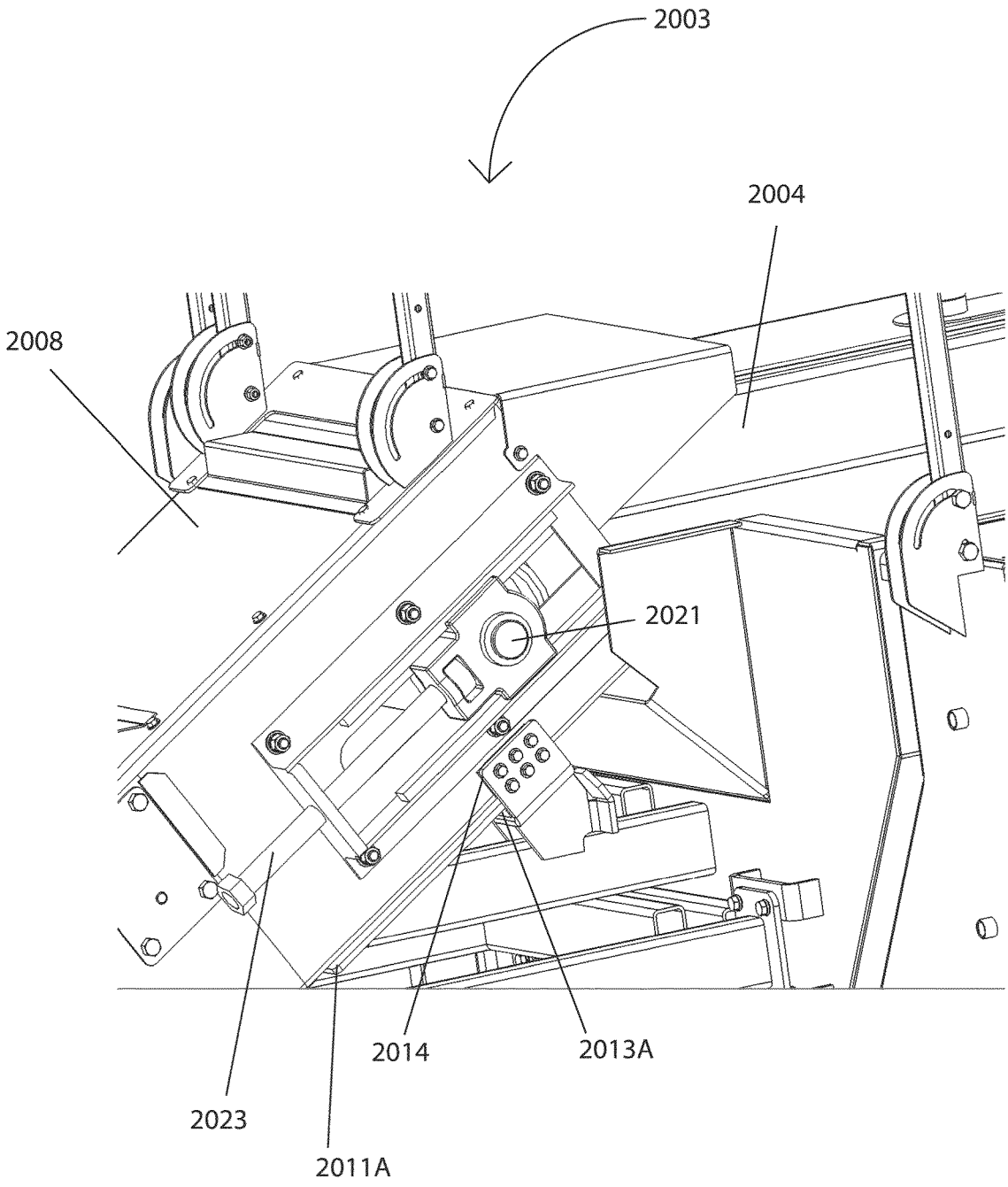
FIG. 17 is a detailed view of an upper portion of a conveyor apparatus of an embodiment of the present invention.

Referring to FIG. 16A, it is seen that one or more motion imparting apparatus 2007 may be attached to the conveyor 2003 to move it from or between the lowermost and uppermost positions. In the illustrated embodiment, the motion imparting apparatus 2007 is in the form of a pair of hydraulic pistons, although other devices may be used including without limitation air pistons, motors, cams, linkages and the like. Referring to the detailed view of FIG. 19, it is seen that the bottom of conveyor 2003 includes one or more smooth exterior surfaces or panels 2011, 2011A. These surfaces are designed to make contact with corresponding bearing surfaces 2012, 2013 on the frame of the vehicle. In some embodiments, two smooth surface panels 2011, 2011A are provided, with the first panel 2011 making contact with a first pair of bearing surfaces 2012, 2012A on the frame, and the second panel 2011A making contact with bearing surfaces 2013, 2013A on the frame. Activation of piston 2007 causes conveyor 2003 to move upward or downward, causing panels 2011, 2011A to slide along bearing surfaces 2012, 2012A, 2013 and 2013A. A plurality of additional bearing surfaces 2014 may also be provided along both sides of the conveyor 2003 to guide the conveyor 2003 along a straight path as it reciprocates between upper and lower positions. In embodiments of the invention, all of the bearing surfaces 2012, 2012A, 2013, 2013A and 2014 as well as panels 2011 and 2011A may be removed and replaced if they become worn, damaged or fatigued.

Figure 9A:
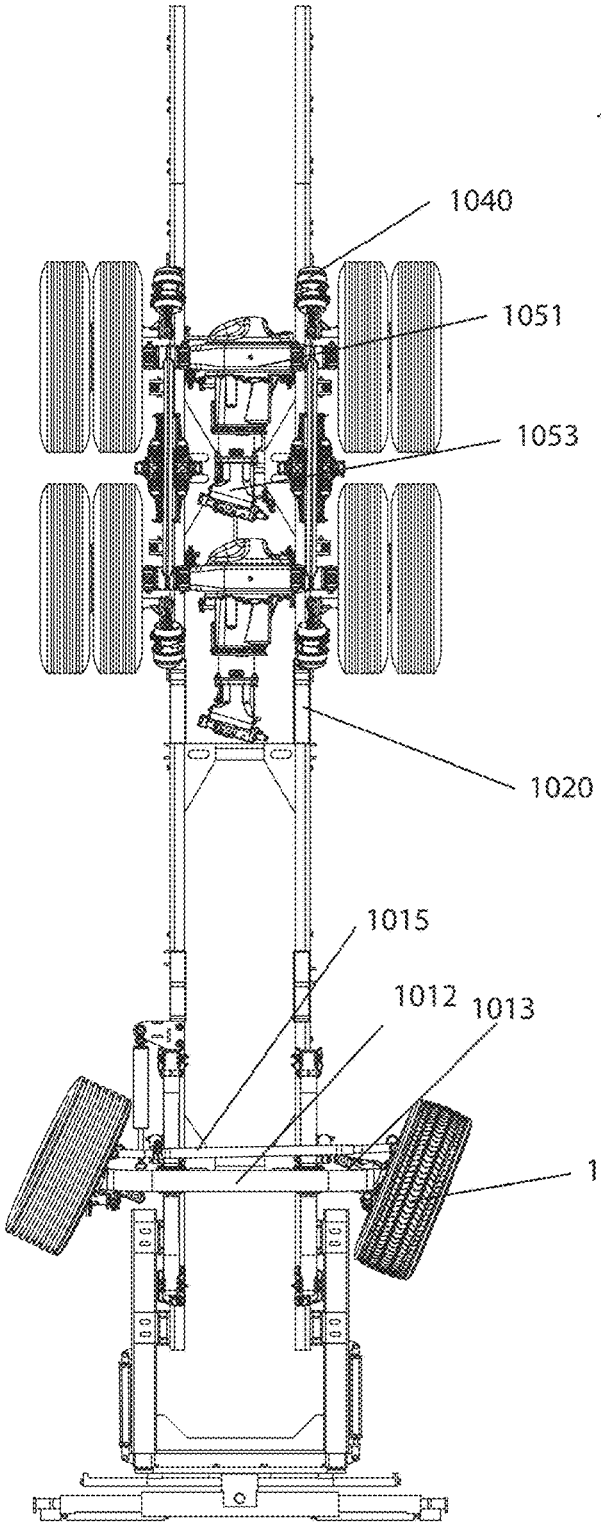
FIG. 9A is a bottom side view of a lower frame assembly of an embodiment of the present invention.
Figure 9B:
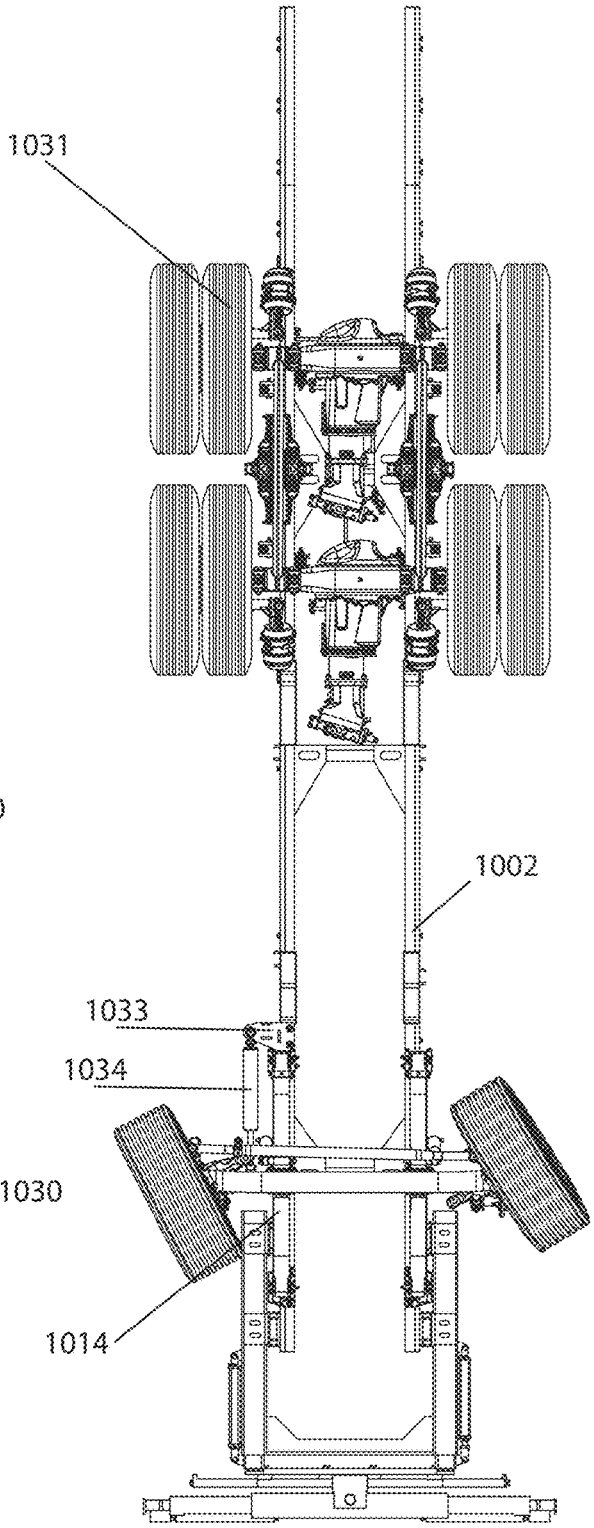
FIG. 9B is a different bottom side view of a lower frame assembly of an embodiment of the present invention.
Figure 10:
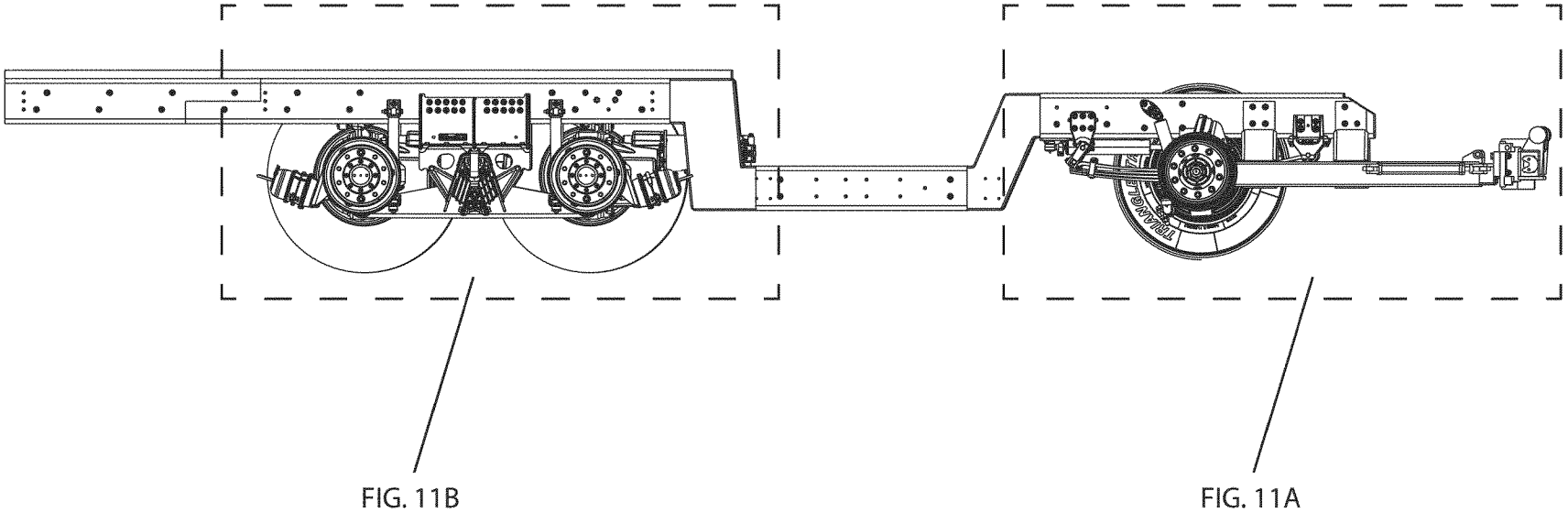
FIG. 10 is a sectional side view of a lower frame assembly of an embodiment of the present invention.

FIG. 8 illustrates an exemplary embodiment of a lower frame assembly 1002 configured to support the various assemblies of the asphalt paving machine, and may include a raised front frame 1010 and a raised rear frame 1020 that are configured to accommodate, respectively, front and rear wheel and axle assemblies. The front frame 1010 may support a front suspension system 1011 that may be operable to provide Ackerman steering geometry. A conveyor system 2003 may also be provided above the front frame 1010. The rear frame 1020 may support a rear axle assembly 1021 that is operable to provide power to the rear wheels for driving the machine 1000 to a work site, and for moving the machine during paving operations. A mixing chamber 1001 for paving materials may be located above the rear frame 1020. The lower central frame area may support an engine, which may be a diesel engine, for operating the hydraulics of the machine. FIGS. 9A and 9B provide a comparison views of the steering angle of the front wheels 1030 illustrating clockwise and counter-clockwise positions. FIG. 10 provides a sectional side view of the lower frame assembly with the right side wheels removed to provide a clear illustration of the components secured to the frame 1002.

As illustrated in FIGS. 11B and 12-14, the illustrated exemplary embodiment of the invention includes a rear axle assembly 1021 that is designed to provide both high and low travel speeds of operation, in addition to spring suspension and air braking. The illustrated embodiment includes a pair of independent drive differentials 1050 coupled to the rear frame 1020. The rear frame may have a flange bracket 1029 that is connected to a bolster spring 1024 that is operable to damp vibrations in from the road. Each of the differentials 1050 may have a strut 1028 that is connected to the rear frame 1020. In some embodiments, as shown in FIG. 14, each of the two differentials 1050 may be in communication with one of two hydraulic motor couplers 1051 (e.g., drive shaft companion flange) that are, in turn, connected to one of two variable displacement hydraulic drive motors 1052. The rear differentials 1050 may have an axle shaft 1053 that secures at least one wheel 1031 to each end of the axle. Each wheel assembly may also include an air brake 1042.

In embodiments of the invention, each of the hydraulic drive motors 1052 may be in hydraulic communication with a main pump that routes a working fluid from a reservoir to a routing block 1054. In such embodiments, the variable displacement hydraulic motors 1052 may provide a regulation of speed and position. Motors 1052 may be operable to propel the paving machine 1000 at road speeds in excess of 25 m.p.h. (up to as high as 60 m.p.h) in both forward and reverse. Motors 1052 may also be used to operate the paving machine at lower speeds (e.g., in the range of 3-5 m.p.h.) during a paving operation. It is to be appreciated that additional torque is provided when motors 1052 are operated at lower speeds, such as during a paving operation; and less torque is provided when motors 1052 are operated at higher speeds, such as when the machine is driven from one project location or another.

The exemplary illustrated dual independent drive differentials 1050 shown in FIG. 14, may be coupled to an independent controller to provide a user with variation and control of the power input to the wheels while maintaining fluid dynamic pressure within the routing system (e.g., hoses connecting the main motor to the routing block 1054). The hydraulic motors 1052 may be hydro static motors (e.g., variable displacement axial piston, reverse displacement axial piston, fixed displacement axial piston), a low-speed high-torque motors (e.g., orbital motor, dowmax axial piston motor), gear motors, or high-speed hydraulic motors (e.g., fixed, variable, high-speed gear type), or the like. In some embodiments, the hydraulic motor couplings 1051 may be in communication with a transmission (e.g., automatic, continuously variable, fully manual, automated manual, etc.). Each of the drive motors 1052 may be independently controlled by the same hydraulic pump that has a flow rate corresponding to the throttle position of the operator.

In some embodiments, as illustrated in FIG. 13 the rear axle assembly may have two wheels 1030 positioned at each end of the axles 1053 (e.g., dually). In such embodiments, the dual wheel configuration provides the load-bearing capabilities to tow and carry a large payload to the work site and the conveyor system 1000 with ease. The differential may be a limited-slip differential, open differential or have a locking mechanism such that the right and left wheels 1030 rotate at the same rate.

Figure 14A:
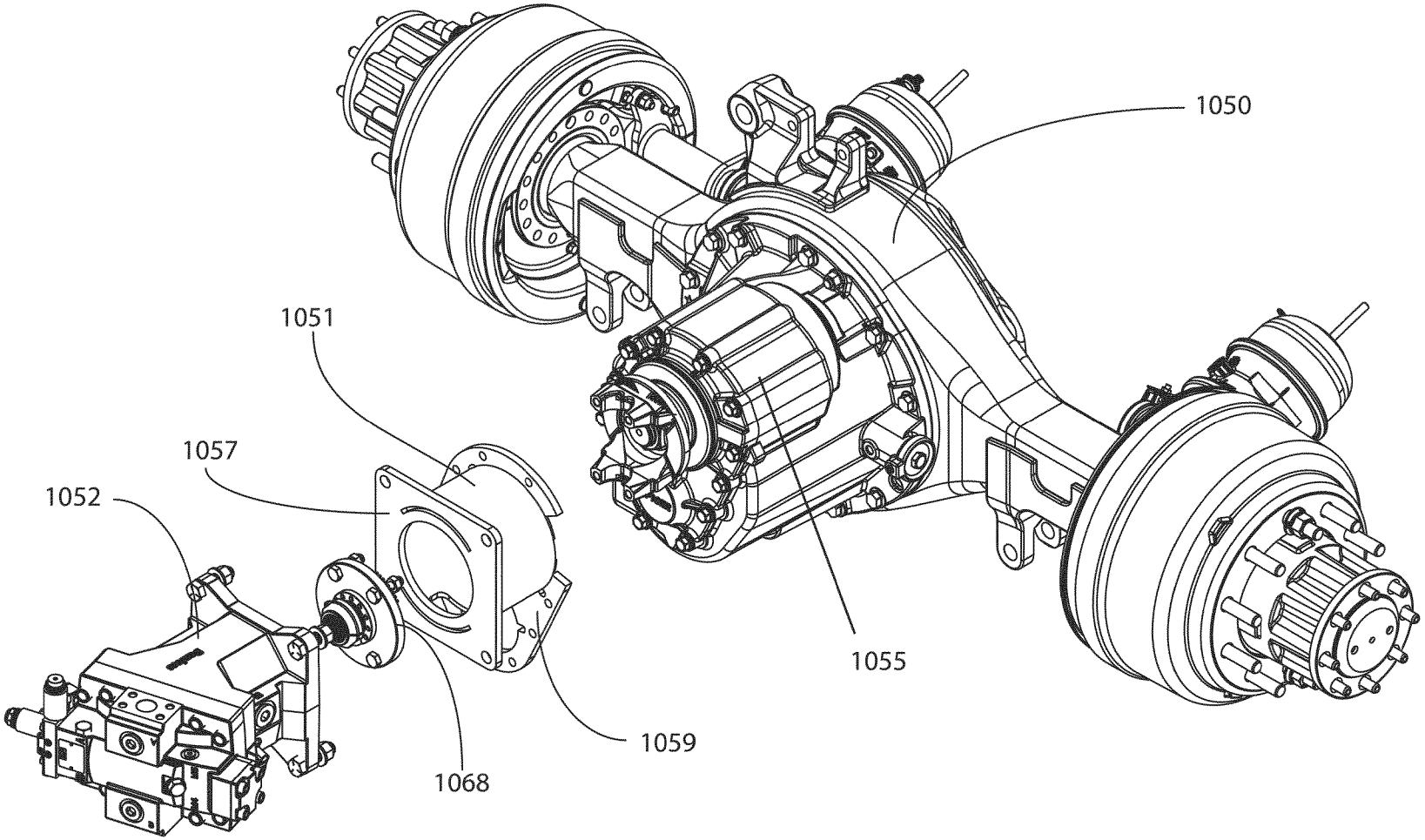
FIG. 14A is an exploded view of one of the rear wheel assemblies of an embodiment of the present invention.
Figure 14B:
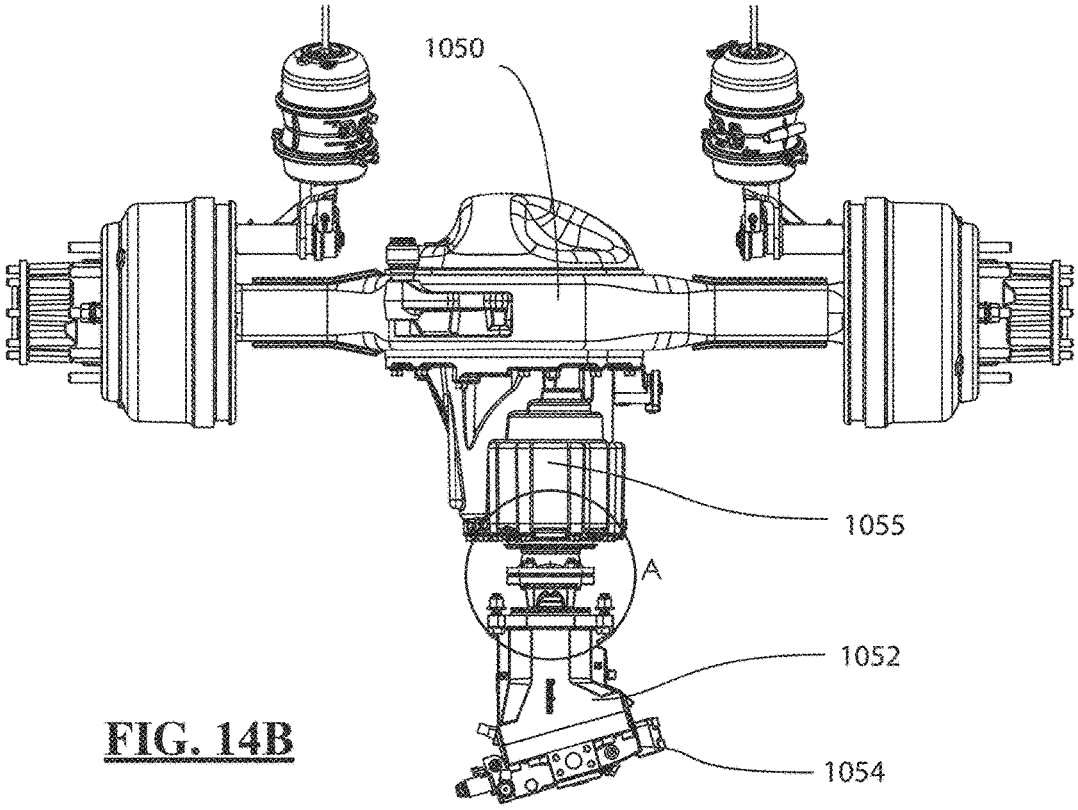
FIG. 14B is a close up bottom view of one of the rear wheel assemblies of an embodiment of the present invention.
Figure 14C:
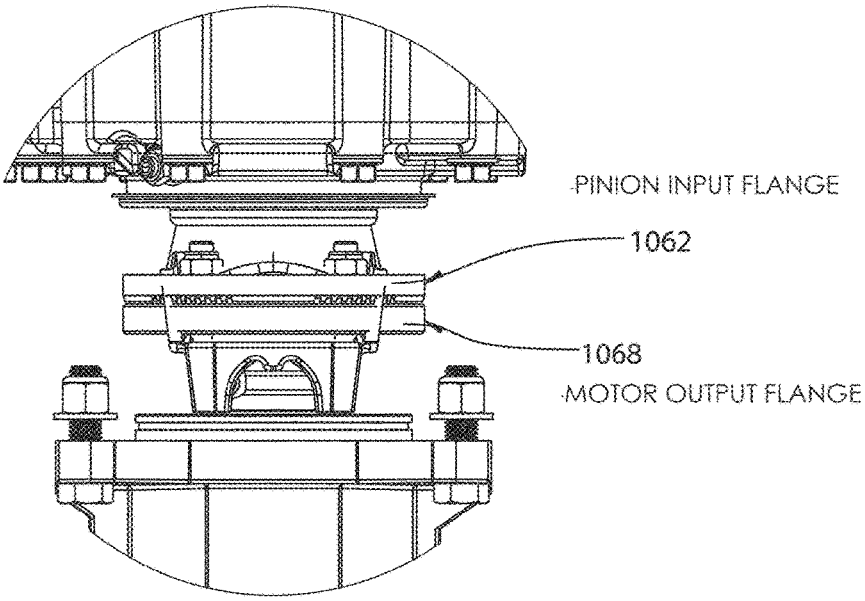
FIG. 14C is a detailed bottom view of area A of FIG. 14B.
Figure 14D:
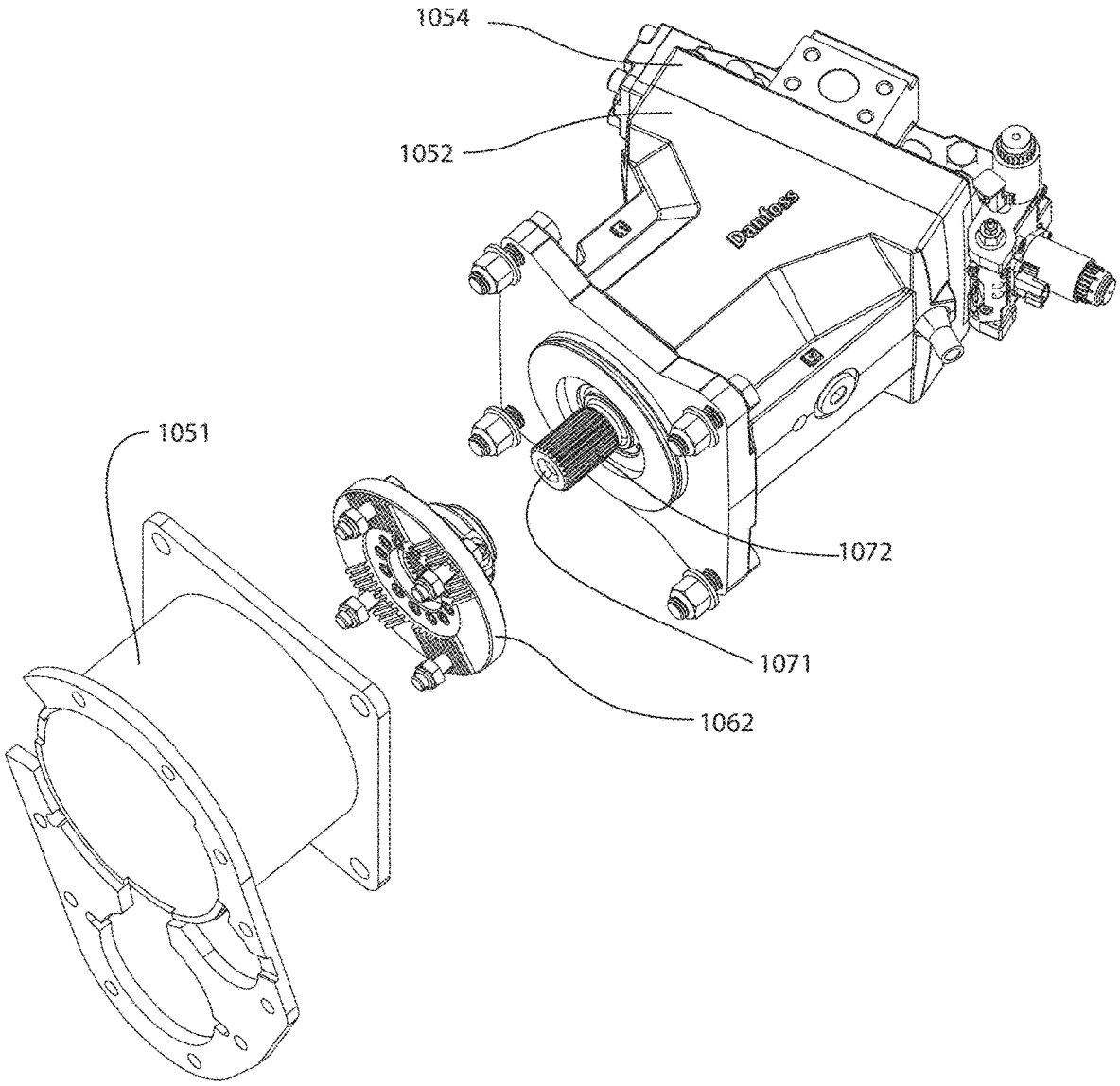
FIG. 14D is a detailed exploded view of one of the rear wheel assemblies of an embodiment of the present invention.
Figure 14E:
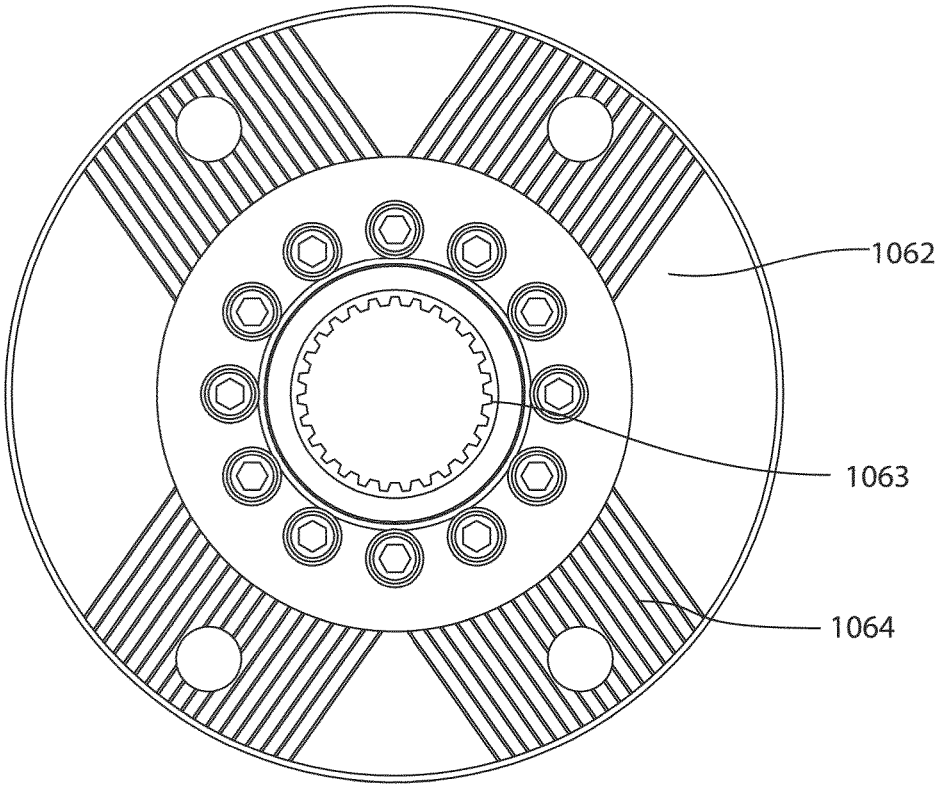
FIG. 14E is an end view of a pinion input flange of an embodiment of the present invention.
Figure 14F:
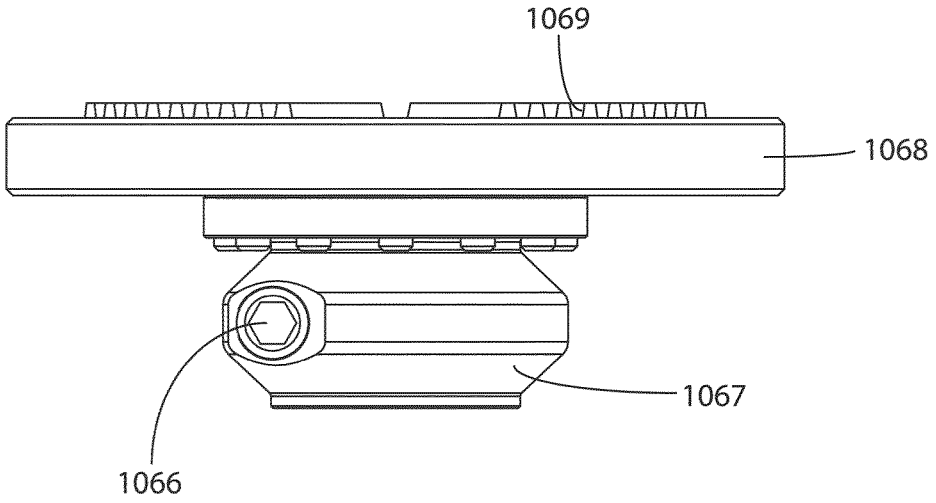
FIG. 14F is side view of a motor output flange of an embodiment of the present invention.
Figure 14G:
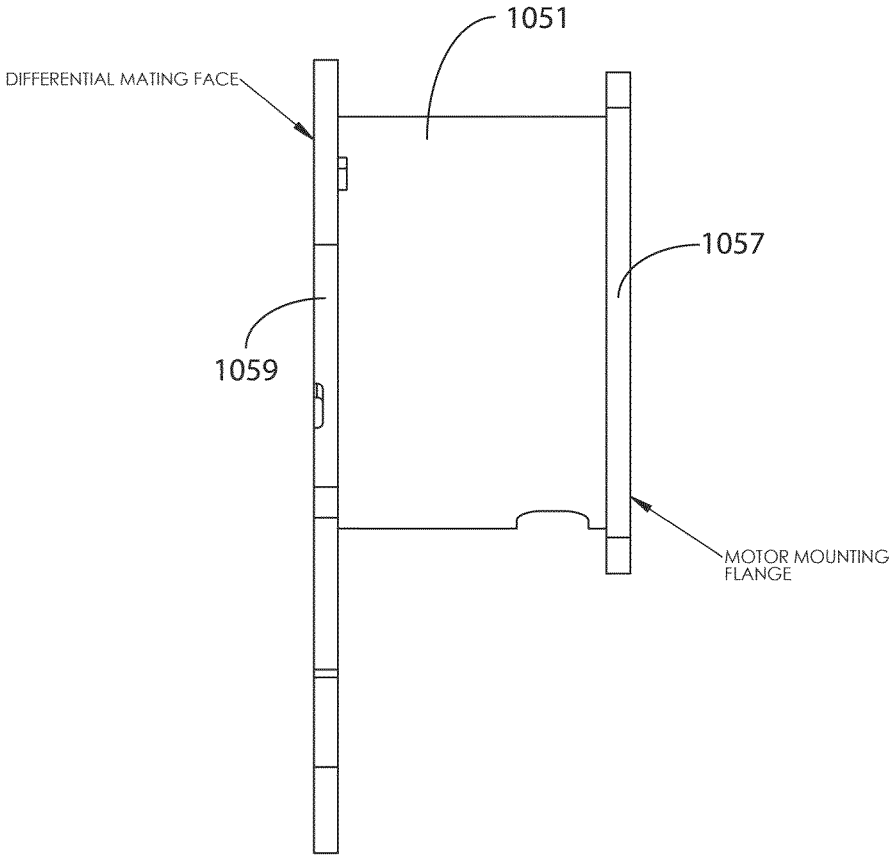
FIG. 14G is a side view of a coupler housing of an embodiment of the present invention.
Figure 14H:
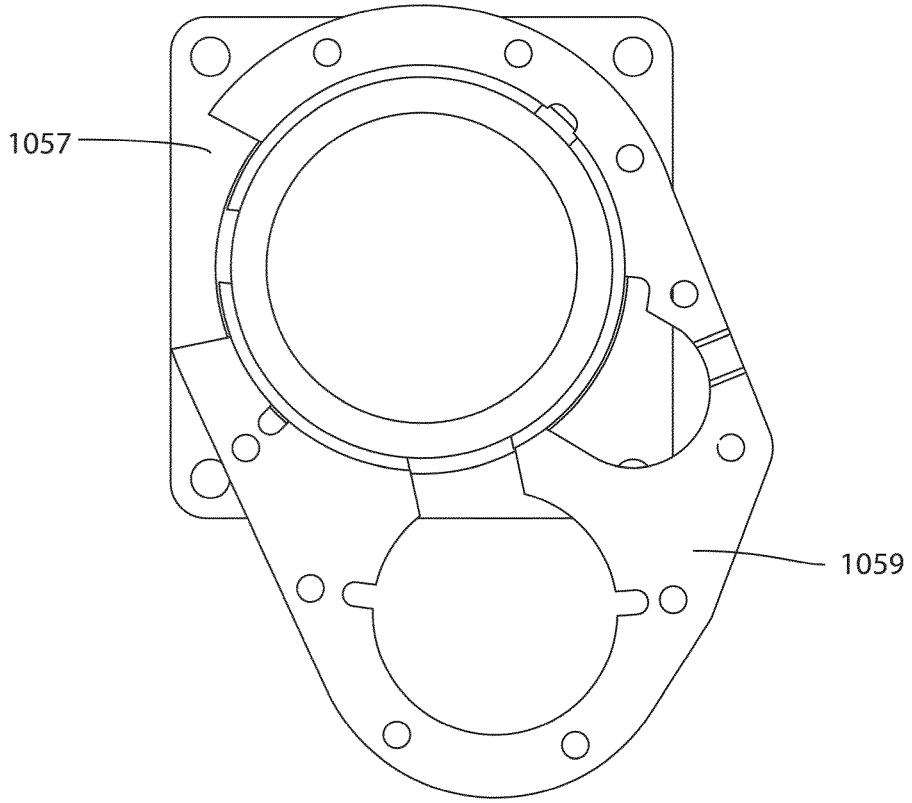
FIG. 14H is an end view of the coupler housing of FIG. 14F.
Figure 15:
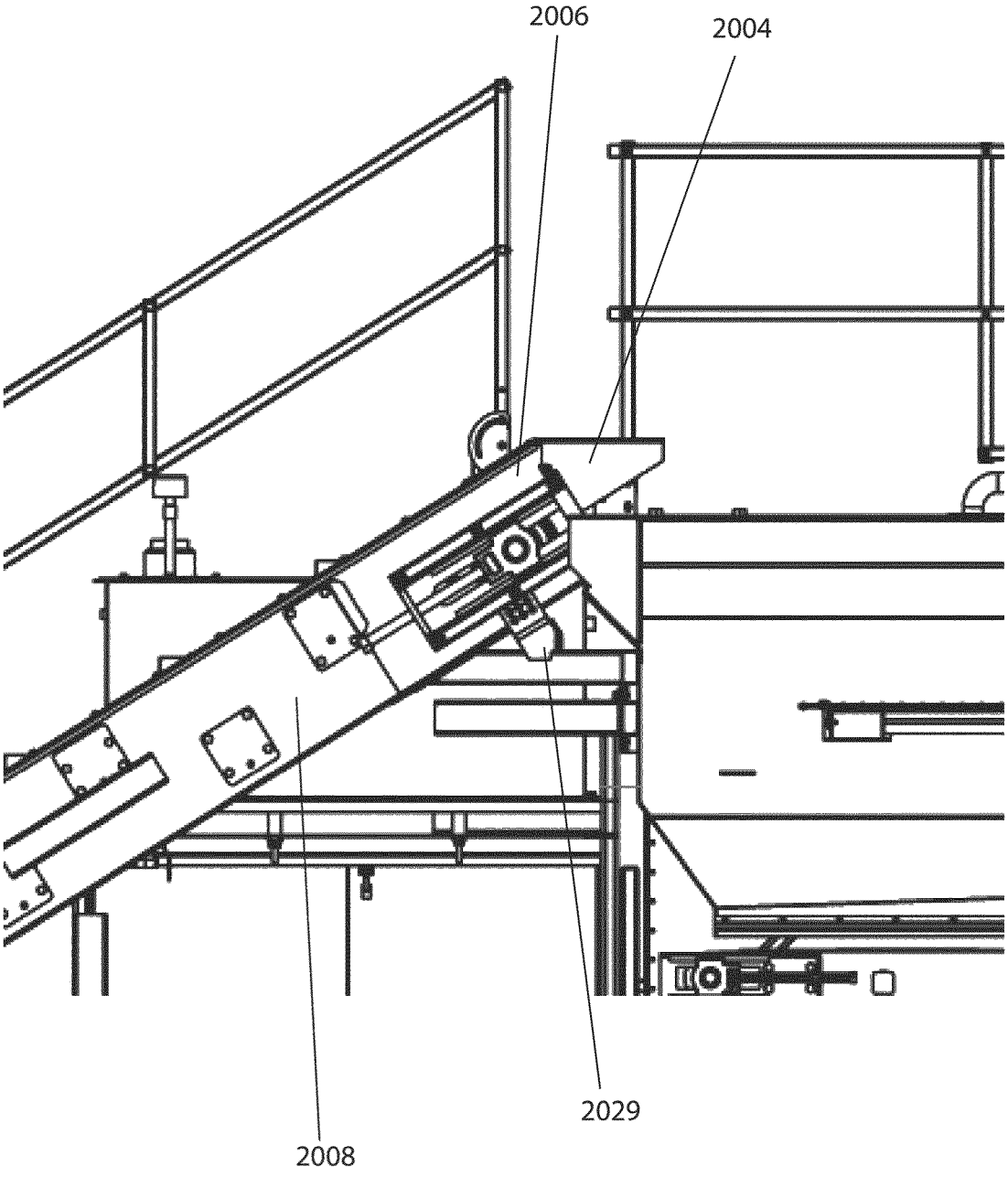
FIG. 15 is a close-up side sectional view of an upper portion of a conveying apparatus of an embodiment of the present invention.

The detailed views of FIGS. 14A-14H illustrate an exemplary embodiment of a coupler 1051 of the present invention provided between a hydraulic motor 1052 and differential 1050 with axle drive 1055. In this exemplary illustrated embodiment, coupler 1051 encloses a rotatable drive shaft 1071 from said motor 1052 that is engaged with a pinion input flange 1062 and a motor output flange 1068. One end of coupler 1051 is attached to motor 1052 using motor mounting flange 1057, and the opposite end of coupler 1051 is attached to axle drive 1055 using flange 1059. FIG. 14E illustrates an end view of a pinion input flange 1062, showing interior teeth 1063 which mate with splines on drive shaft 1071. A plurality of ridges and troughs 1064 are provided in a pattern on flange 1062 which fit into to a plurality of corresponding troughs and ridges 1069 on output flange 1068. A hub 1067 is provided on flange 1068 which fits over drive shaft 1071, and may be securely engaged therewith using bolt 1066.

Rotation may be imparted to shaft 1071 from hydraulic motor 1052 which causes rotation of hub 1067, flange 1068 and troughs and ridges 1069. The interengagement of troughs and ridges 1069 with ridges and troughs 1064 on pinion input flange 1062, together with mating of splines 1072 and teeth 1063, causes the same rotation from motor 1052 to be directly imparted to input flange 1062. This rotation is transmitted through axle drive 1055 to differential 1050 and ultimately to the wheels 1031.

In some embodiments, each of the rear wheels 1031 may have an air brake mechanism 1042 that is concentrically positioned at the wheel hub 1035 and is operable to stop the rotation of the wheels, thereby the vehicle. Each of the air brakes 1042 may be coupled to a brake control assembly 1045 to a quick-release valve that is in communication with a supply reservoir and compressor to actuate the braking action. It is to be appreciated that the air brakes, the hydraulic motors and other components of the paving machine are all operated by a central controller which controls all paving operations, including accommodation for variations in speed. For example and without limitation, when increased speed is requested, the hydraulic pump will gradually provide increased pressure to the hydraulic motors to increase speed; on the other hand, when the air brakes are applied, the controller recognizes that power to the hydraulic motors should be diminished, and reduces pressure, in order to slow the speed of the vehicle. In some embodiments, each of the air brakes may be in communication with an ABS controller and relay assembly 1056 that is attached to the front end of the frame 1002.

Figure 11A:
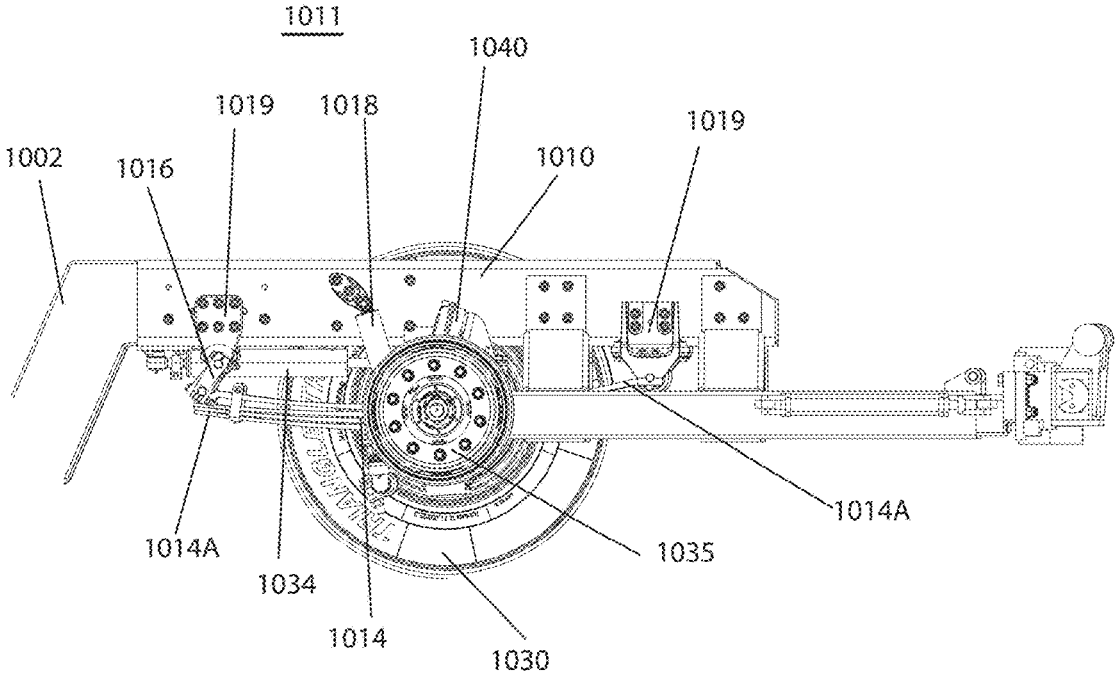
FIG. 11A is an expanded sectional side view of a lower front frame assembly of an embodiment of the present invention.
Figure 11B:
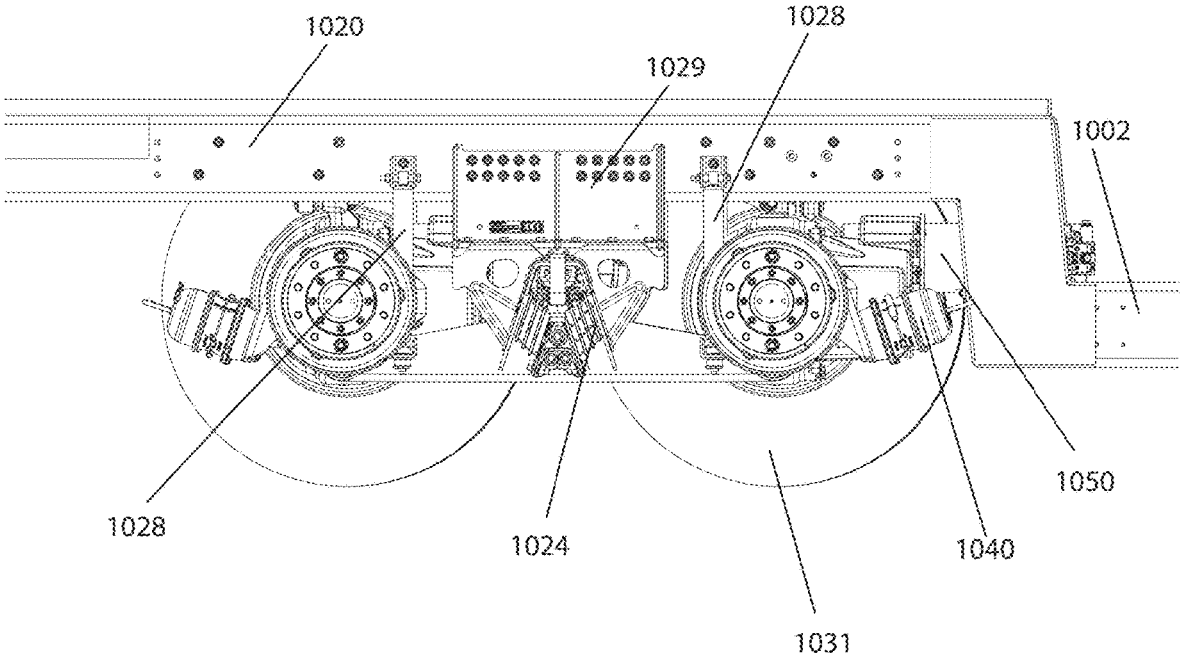
FIG. 11B is an expanded sectional side view of a lower rear frame assembly of an embodiment of the present invention.
Figure 12:
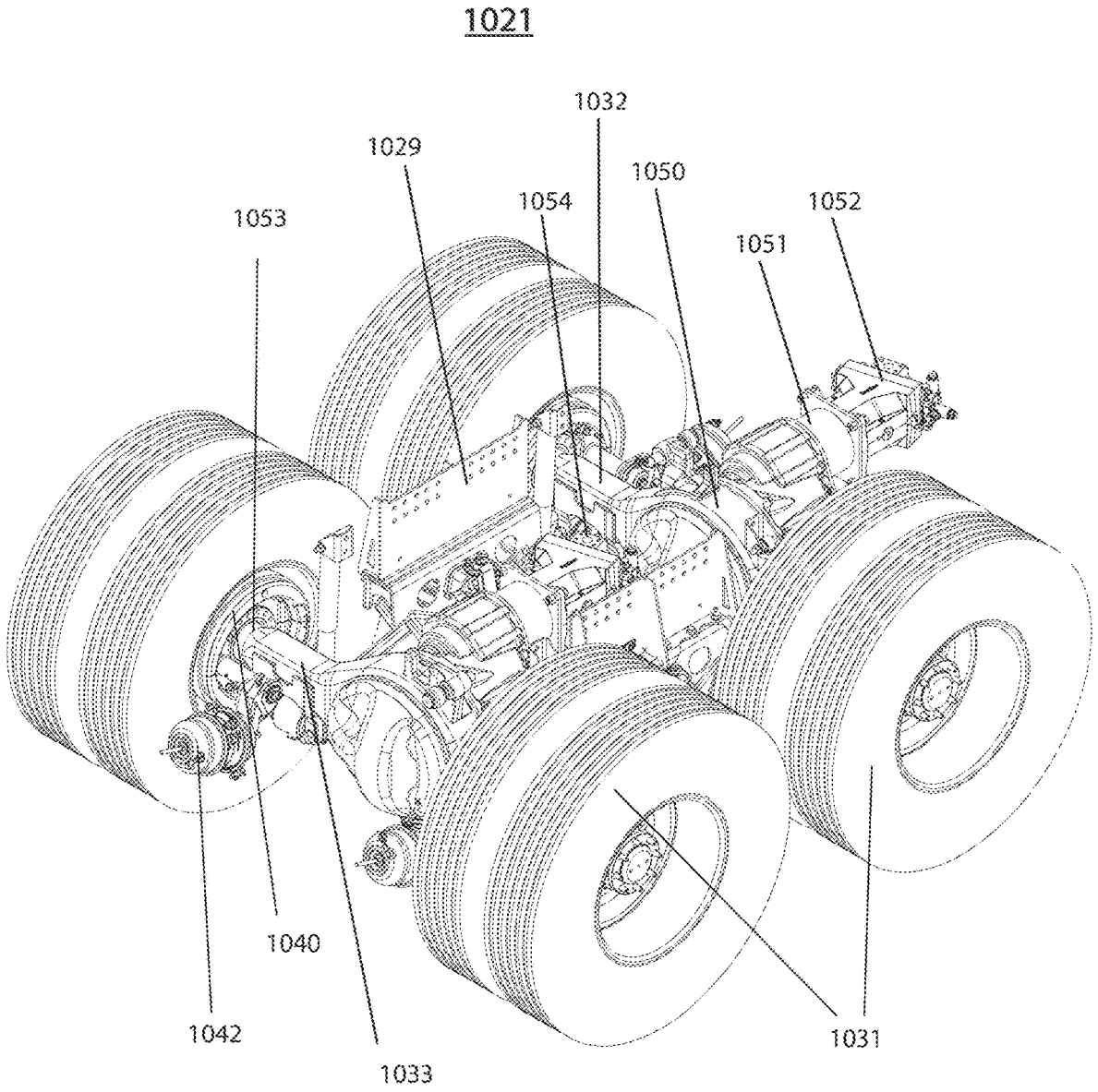
FIG. 12 is a perspective view of a rear wheel assembly of an embodiment of the present invention.

As best illustrated in FIGS. 9A, 9B and 11A, it is seen that the illustrated exemplary front suspension system 1011 includes a front axle 1012 having steering knuckles 1013 at opposite ends and is secured to the front frame 1010 with a leaf spring 1014 and a strut 1018 connected to the front frame 1010. The leaf springs 1014 may have a forward end 1014A that connects to the front frame 1010 via a flange 1019 equipped with a rotating bar pin end bushing to allow for rotation and safe driving. The leaf springs 1014 may have a rear end 1014B connecting to a flange 1019. In some embodiments, the leaf spring rear end 1014B may connect to an intermediary pivot link 1016 that provides damping of road vibration and allows for the compression of the front suspension 1011 when the machine 1000 is driven in dynamic or uneven road conditions. The steering knuckles 1013 of a right, and left wheel may be in communication with a tie rod assembly 1015 that is operable to maintain the steering angle of the front wheels 1030. In some embodiments, the tie rod assembly 1015 may include a tie rod end arm that is operable to adjust the toe of the front wheels 1030 with respect to the centerline of the vehicle frame 1002. The steering knuckles 1030 may axially secure and align a wheel hub 1035 with the front axle 1012, and connect to a hydraulic actuator 1034. The wheel hub 1035 may have a drum air disk brake assembly 1040 and may secure the wheels to the steering assembly 1011. The maximum turning positions shown in FIGS. 9A and 9B are determined by the position of the hydraulic actuator 1034 that is in communication with the steering wheel of an operators control cabin.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein, and that different combinations of the features of the illustrated embodiments may be used in other embodiments, all within the scope of the invention. The illustrated embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A coupling provided between a hydraulic motor and a differential of a vehicle axle comprising:

a) a rotatable drive shaft extending from said motor, said drive shaft having a plurality of splines along an exterior surface thereof;

b) a motor output flange having a central opening therein for receiving the drive shaft, and a plurality of troughs and ridges on an exterior surface thereof; and c) a pinion input flange having a plurality of ridges and troughs on an exterior surface thereof that mate with the troughs and ridges of said motor output flange, said pinion input flange having a central opening therein, said central opening comprising a plurality of inwardly extending teeth that mate with the splines on the drive shaft.

2. The coupling of claim 1 further comprising a hub provided on the motor output flange having a central opening for receiving said drive shaft, said hub including a movable bolt thereon for securely engaging said hub with said drive shaft.

3. The coupling of claim 2 further comprising a housing provided around said motor output flange and said pinion input flange, said housing having a first end attached to said motor, and an opposite end attached to said differential.

4. The coupling of claim 1 further comprising a) a support frame having a pair of rear drive axles engaged therewith, each such axle including a differential attached to a drive axle, and b) a pair of hydraulic motors, one for each of said pair of rear axles, wherein a pair of said couplings are provided, one coupling located between each of said hydraulic motors and its respective differential.

5. The coupling of claim 4 further comprising a spring suspension system for each of said rear axles.

6. The coupling of claim 4 further comprising an air brake system for each of said rear axles.

7. The coupling of claim 4 further comprising an input hopper attached to a front of said frame for receiving asphalt materials from a supply truck.

8. The coupling of claim 7 further comprising an angled conveyor assembly above said front frame for conveying said materials received from said hopper assembly to an interior mixing chamber of a paving machine mounted on said frame.

9. The coupling of claim 8 wherein said conveyor is capable of reciprocating between a first lower position and a second upper position.

10. The coupling of claim 9 further comprising a mixing apparatus above a rear portion of said frame.

11. The coupling of claim 10 further comprising an observation platform at the rear portion of said frame.

12. The coupling of claim 4 further comprising an engine above a central portion of said frame.

* * * * *